US006848940B2

(12) United States Patent
Montena

(10) Patent No.: US 6,848,940 B2
(45) Date of Patent: Feb. 1, 2005

(54) CONNECTOR AND METHOD OF OPERATION

(75) Inventor: Noah P Montena, Syracuse, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 0 days.

(21) Appl. No.: 10/348,652

(22) Filed: Jan. 21, 2003

(65) Prior Publication Data

US 2003/0114045 A1 Jun. 19, 2003

Related U.S. Application Data

(63) Continuation of application No. 09/621,975, filed on Jul. 21, 2000, now Pat. No. 6,558,194, which is a continuation of application No. 08/910,509, filed on Aug. 2, 1997, now Pat. No. 6,153,830.

(51) Int. Cl.[7] ..... H01R 17/04
(52) U.S. Cl. ..... 439/584
(58) Field of Search ..... 439/583, 584, 439/578; D13/133

(56) References Cited

U.S. PATENT DOCUMENTS

| | | | | |
|---|---|---|---|---|
| 2,258,737 | A | 10/1941 | Browne | 173/332 |
| 3,184,706 | A | 5/1965 | Atkins | |
| 3,275,913 | A | 9/1966 | Blanchard | 317/249 |
| 3,355,698 | A | 11/1967 | Keller | |
| 3,406,373 | A | 10/1968 | Forney, Jr. | |
| 3,498,647 | A | 3/1970 | Schroder | 285/343 |
| 3,629,792 | A | 12/1971 | Dorrell | |
| 3,671,922 | A | 6/1972 | Zerlin et al. | |
| 3,710,005 | A | 1/1973 | French | 174/89 |
| 3,845,453 | A | 10/1974 | Hemmer | |
| 3,915,539 | A | 10/1975 | Collins | |
| 3,936,132 | A | 2/1976 | Hutter | |
| 3,985,418 | A | 10/1976 | Spinner | |
| 4,046,451 | A | 9/1977 | Juds et al. | |
| 4,053,200 | A | 10/1977 | Pugner | |

(List continued on next page.)

FOREIGN PATENT DOCUMENTS

| | | |
|---|---|---|
| DE | 1 191 880 | 4/1954 |
| DE | 32 11 008 | 10/1983 |
| EP | 0 265 276 | 4/1988 |
| GB | 1087 228 | 10/1967 |
| GB | 1270846 | 4/1972 |
| GB | 2019665 | 10/1979 |
| GB | 2079 549 A | 1/1982 |

OTHER PUBLICATIONS

Raychem Promotional Materials: "The EZF connector is the easy way to fight RFleakage, moisture damage and corrosion," production numbers LRC 1447–1460.
SPL6 Stirling Connector Samples.
Stirling Connectors Inc. Press Release Concerning SPL6 Push and Lock Connector, Jun. 1997.

*Primary Examiner*—Renee Luebke
(74) *Attorney, Agent, or Firm*—Schmeiser, Olsen & Watts

(57) ABSTRACT

A connector includes a connector body, a post member, and a fastener member. In one embodiment, the connector provides for coupling a coaxial cable having a center conductor, an insulator core, an outer conductor, and a sheath to a terminal device. A nut coupled to either the connector body or post member can be used on the connector to make the connection to the device. The post member has a cavity that accepts the center conductor and insulator core of a coaxial cable. An outer cavity is formed by the connector body and the post member such that the outer conductor and the sheath of a coaxial cable are positioned therebetween. The fastener member, in a pre-installed first configuration is movably fastened onto the connector body. The fastener member can be moved toward the nut into a second configuration in which the fastener member coacts with the connector body so that the connector sealingly grips the coaxial cable.

23 Claims, 22 Drawing Sheets

U.S. PATENT DOCUMENTS

| | | | | |
|---|---|---|---|---|
| 4,059,330 | A | 11/1977 | Shirey | |
| 4,126,372 | A | 11/1978 | Hashimoto et al. | |
| 4,156,554 | A | 5/1979 | Aujla | |
| 4,168,921 | A | 9/1979 | Blanchard | 403/19 |
| 4,173,385 | A | 11/1979 | Fenn et al. | |
| 4,227,765 | A | 10/1980 | Neumann et al. | |
| 4,280,749 | A | 7/1981 | Hemmer | |
| 4,339,166 | A | 7/1982 | Dayton | |
| 4,346,958 | A | 8/1982 | Blanchard | |
| 4,354,721 | A | 10/1982 | Luzzi | |
| 4,373,767 | A | 2/1983 | Cairns | |
| 4,400,050 | A | 8/1983 | Hayward | |
| 4,408,821 | A | 10/1983 | Forney, Jr. | |
| 4,408,822 | A | 10/1983 | Nikitas | |
| 4,444,453 | A | 4/1984 | Kirby et al. | |
| 4,484,792 | A | 11/1984 | Tengler et al. | |
| 4,533,191 | A | 8/1985 | Blackwood | |
| 4,545,637 | A | 10/1985 | Bosshard et al. | |
| 4,575,274 | A | 3/1986 | Hayward | 403/2 |
| 4,583,811 | A | 4/1986 | McMills | |
| 4,596,435 | A | 6/1986 | Bickford | |
| 4,600,263 | A | 7/1986 | DeChamp et al. | |
| 4,614,390 | A | 9/1986 | Baker | |
| 4,645,281 | A | 2/1987 | Burger | |
| 4,650,228 | A | 3/1987 | McMills et al. | 285/381 |
| 4,655,159 | A | 4/1987 | McMills | 116/212 |
| 4,660,921 | A | 4/1987 | Hauver | |
| 4,668,043 | A | 5/1987 | Saba et al. | |
| 4,674,818 | A | 6/1987 | McMills et al. | 439/275 |
| 4,676,577 | A | 6/1987 | Szegda | 439/584 |
| 4,684,201 | A | 8/1987 | Hutter | |
| 4,691,976 | A | 9/1987 | Cowen | 439/394 |
| 4,738,009 | A | 4/1988 | Down | 29/33 |
| 4,746,305 | A | 5/1988 | Nomura | 439/319 |
| 4,747,786 | A | 5/1988 | Hayashi et al. | 439/95 |
| 4,755,152 | A | 7/1988 | Elliot et al. | 439/452 |
| 4,806,116 | A | 2/1989 | Ackerman | 439/304 |
| 4,813,886 | A | 3/1989 | Roos et al. | 439/578 |
| 4,834,675 | A | 5/1989 | Samchisen | 439/578 |
| 4,854,893 | A | 8/1989 | Morris | 439/578 |
| 4,857,014 | A | 8/1989 | Alf et al. | 439/578 |
| 4,869,679 | A | 9/1989 | Szegda | 439/272 |
| 4,892,275 | A | 1/1990 | Szegda | 248/61 |
| 4,902,246 | A | 2/1990 | Samchisen | 439/578 |
| 4,906,207 | A | 3/1990 | Banning et al. | 439/578 |
| 4,923,412 | A | 5/1990 | Morris | 439/578 |
| 4,925,403 | A | 5/1990 | Zorzy | 439/578 |
| 4,929,188 | A | 5/1990 | Lionetto et al. | 439/349 |
| 4,990,104 | A | 2/1991 | Schieferly | 439/578 |
| 4,990,105 | A | 2/1991 | Karlovich | 439/578 |
| 4,990,106 | A | 2/1991 | Szegda | 439/585 |
| 5,002,503 | A | 3/1991 | Campbell et al. | 439/578 |
| 5,021,010 | A | 6/1991 | Wright | 439/578 |
| 5,024,606 | A | 6/1991 | Ming-Hwa | 439/578 |
| 5,037,328 | A | 8/1991 | Karlovich | 439/578 |
| 5,062,804 | A | 11/1991 | Jamet et al. | 439/394 |
| 5,066,248 | A | 11/1991 | Gaver | 439/578 |
| 5,073,129 | A | 12/1991 | Szegda | 439/585 |
| 5,083,943 | A | 1/1992 | Tarrant | 439/583 |
| 5,127,853 | A | 7/1992 | McMills et al. | 439/578 |
| 5,131,862 | A | 7/1992 | Gershfeld | 439/357 |
| 5,141,451 | A | 8/1992 | Down | 439/585 |
| 5,181,161 | A | 1/1993 | Hirose et al. | 369/48 |
| 5,195,906 | A | 3/1993 | Szegda | 439/394 |
| 5,205,761 | A | 4/1993 | Nilsson | 439/578 |
| 5,207,602 | A | 5/1993 | McMills et al. | 439/836 |
| 5,217,391 | A | 6/1993 | Fisher, Jr. | 439/578 |
| 5,217,393 | A | 6/1993 | Del Negro et al. | 439/585 |
| 5,269,701 | A | 12/1993 | Leibfried, Jr. | 439/578 |
| 5,283,853 | A | 2/1994 | Szegda | 385/139 |
| 5,295,864 | A | 3/1994 | Birch et al. | 439/578 |
| 5,316,494 | A | 5/1994 | Flanagan et al. | 439/352 |
| 5,338,225 | A | 8/1994 | Jacobsen et al. | 439/585 |
| 5,342,218 | A | 8/1994 | McMills et al. | 439/578 |
| 5,371,819 | A | 12/1994 | Szegda | 385/75 |
| 5,371,821 | A | 12/1994 | Szegda | 385/87 |
| 5,371,827 | A | 12/1994 | Szegda | 385/136 |
| 5,393,244 | A | 2/1995 | Szegda | 439/394 |
| 5,431,583 | A | 7/1995 | Szegda | 439/589 |
| 5,444,810 | A | 8/1995 | Szegda | 385/139 |
| 5,455,548 | A | 10/1995 | Grandchamp et al. | 333/260 |
| 5,456,611 | A | 10/1995 | Henry et al. | 439/180 |
| 5,456,614 | A | 10/1995 | Szegda | 439/321 |
| 5,466,173 | A | 11/1995 | Down | 439/584 |
| 5,470,257 | A | 11/1995 | Szegda | 439/578 |
| 5,494,454 | A | 2/1996 | Johnsen | 439/394 |
| 5,501,616 | A | 3/1996 | Holliday | 439/585 |
| 5,525,076 | A | 6/1996 | Down | 439/585 |
| 5,542,861 | A | 8/1996 | Anhalt et al. | 439/578 |
| 5,548,088 | A | 8/1996 | Gray et al. | 174/74 |
| 5,586,910 | A | 12/1996 | Del Negro et al. | 439/584 |
| 5,598,132 | A | 1/1997 | Stabile | 333/22 R |
| 5,607,325 | A | 3/1997 | Toma | 439/578 |
| 5,651,699 | A | 7/1997 | Holliday | 439/585 |
| 5,667,405 | A | 9/1997 | Holliday | 439/585 |
| 5,863,220 | A | 1/1999 | Holliday | 439/584 |
| 5,975,951 | A | 11/1999 | Burris et al. | 439/585 |
| 5,997,350 | A | 12/1999 | Burris et al. | 439/585 |
| 6,032,358 | A | 3/2000 | Wild | 29/863 |

CONNECTOR AND METHOD OF OPERATION

This application is a continuation of application Ser. No. 09/621,975, filed on Jul. 21, 2000, now U.S. Pat. No. 6,558,194, which is a continuation of Ser. No. 08/910,509 filed on Aug. 2, 1997, now U.S. Pat. No. 6,153,830.

FIELD OF THE INVENTION

This invention relates to connectors used to couple cables to equipment ports, terminals, or the like. The invention is particularly useful in, although not limited to, universal connectors for coaxial cables of the type employed in the cable television industry.

BACKGROUND OF THE INVENTION

In using electronic devices such as televisions and video tape machines, it is desired to connect such devices either together or to other sources of electronic signals. Typically, a television may be hooked up to a cable service that enters the home through coaxial cables. Such cables are connected to the television by use of one or more connectors.

The conventional coaxial cable typically contains a centrally located electrical conductor surrounded by and spaced inwardly from an outer cylindrical braid conductor. The center and braid conductors are separated by a foil and an insulator core, with the braid being encased within a protective sheathing jacket. In some typical coaxial cables, a foil layer is not used such that the outer braid conductor surrounds the insulator core.

Conventional coaxial cable end connectors typically include an inner cylindrical post adapted to be inserted into a suitably prepared end of the cable between the foil and the outer braid conductor, an end portion of the latter having been exposed and folded back over the sheath jacket. The center conductor, the insulator core, and the foil thus form a central core portion of the cable received axially in the inner post, whereas the outer braid conductor and sheathing jacket comprise an outer portion of the cable surrounding the inner post.

The conventional coaxial cable end connector further includes an outer component designed to coact with an inner post in securely and sealingly clamping the outer portion of the cable therebetween. In "crimp type" end connectors, the outer component is a connector body fixed in relation to and designed to be deformed radially inwardly towards the inner post by a crimping tool. Typical examples of crimp type end connectors are described in U.S. Pat. No. 5,073,129 (Szegda); U.S. Pat. No. 5,083,943 (Tarrant); and U.S. Pat. No. 5,501,616 (Holliday), which are incorporated herein in their entirety.

In the so-called "radial compression type" end connectors, the outer component is a substantially non-deformable sleeve adapted to be shifted axially with respect to the inner post into a clamped position coacting with the inner post to clamp the prepared cable end therebetween. Typical examples of radial compression type connectors are described in U.S. Pat. No. 3,710,005 (French); U.S. Pat. No. 4,676,577 (Szegda); and U.S. Pat. No. 5,024,606 (Yeh Ming-Hwa), which are incorporated herein in their entirety.

These radial compression type end connectors suffer from a common disadvantage in that prior to being mounted on the cable ends, the outer sleeve components are detached and separated from the inner post and/or connector members. As such, the outer sleeve components are prone to being dropped or otherwise becoming misplaced or lost, particularly, as is often the case, when an installation is being made outdoors under less than ideal weather conditions.

In other attempts, connectors have been made by detachably interconnecting the connector body and outer sleeve component in a parallel side-by-side relationship. This is intended to facilitate pre-installation handling and storage. However, during installation, the outer sleeve component must still be detached from the connector body and threaded or inserted onto the cable as a separate element. Thus, mishandling or loss of the outer sleeve component remains a serious problem during the critical installation phase.

U.S. Pat. No. 5,295,864 (Birch et al), which is also incorporated herein in its entirety, discloses a radial compression type end connector with an integral outer sleeve component. Here, however, the outer sleeve component is shifted into its clamped position as a result of the connector being threaded onto an equipment port or the like. Before the clamped position is achieved, the end connector is only loosely assembled on and is thus prone to being dislodged from the cable end. This again creates problems for the installer.

Another shortcoming of known connectors is the need for an O-ring or similar sealing member to prevent moisture from penetrating the end connector between the connector body and the outer sleeve component.

Accordingly, there is a continued need for improved connectors in view of the problems associated with known connectors, and which may be utilized with a wide range of cable types and sizes. In addition, there is continued need for improved connectors that are relatively uncomplicated in structure and which are economical to fabricate.

SUMMARY OF THE INVENTION

The present invention is directed to a connector comprising body member including a post member defining an inner first cavity, and further including a connector body coupled to the post member and defining therebetween an outer first cavity, the post member having a first opening and a second opening each communicating with the inner first cavity, and the connector body having at least one opening communicating with said outer first cavity; and fastener member defining a second cavity and having a first opening and a second opening each communicating with the second cavity, at least a portion of the fastener member being movably disposed on the connector body in a first configuration, and capable of being disposed on the connector body in a second configuration in which the volume of the outer first cavity is decreased.

In a preferred embodiment, the fastener member, in a first configuration, is press fitted onto the connector body. Also the fastener member has an internal groove. The connector body has a detent disposed on its outer surface such that the detent is movably disposed in the internal groove in the first configuration. The detent, in the second configuration, is disposed on the inner surface of the fastener member.

The present invention is also directed to a coaxial cable connector comprising body member including a post member defining an inner first cavity, and further including a connector body coupled to said post member and defining therebetween an outer first cavity, the post member having a first opening and a second opening each communicating with said inner first cavity, and said connector body having at least one opening communicating with said outer first cavity; and fastener member defining a second cavity and having a first opening and a second opening each communicating with said second cavity, at least a portion of the fastener member being movably fastened on the connector body in a first configuration, and capable of being fastened on the connector body in a second configuration in which the volume of the outer first cavity is decreased.

Preferably the connector body and post member are each generally tubular.

The connector body is fastened to a portion of the post member adjacent the second opening of the post member, and the opening of the connector body is adjacent to the first opening of the post member. In the first configuration, the first opening of the fastener member is adjacent and communicates with the opening of the outer first cavity. The area of the first opening of the fastener member is greater than the area of the opening of the connector body.

The connector body has at least one or a plurality of serrations disposed on an inner surface thereof. The fastener member is generally tubular having at least a portion thereof with an inner diameter being less than the maximum outer diameter of at least a portion of the connector body adjacent the opening of the outer first cavity. The connector body has a flange disposed on a portion of an outer surface of the connector body. The flange is positioned to contact the fastener member fastened onto the connector body in the second configuration. The connector further comprises a nut member, coupled to at least one of the body member and the post member, adjacent said second opening of said post member. The connector can further comprise a sealing member such as an O-ring disposed between the nut member and the body member. The post member has a ridge disposed in the first inner cavity adjacent the second opening of the post member.

In preferred embodiments, the post member, connector body and fastener member can be metallic. Alternatively, they can be formed of reinforced plastic material. In one preferred embodiment, the connector body is formed of a plastic composition.

Also the present invention is directed to a coaxial cable connector comprising first body means for coupling to a coaxial cable, and including a post means for defining an inner first cavity, and further including a connector body means coupled to the post means and defining therebetween an outer first cavity, the post means having a first opening and a second opening each communicating with the inner first cavity, and the connector body means having at least one opening communicating with the outer first cavity, the first and second openings of the post means allowing for passage of at least a portion of the coaxial cable, and the outer first cavity allowing for entry of at least another portion of the coaxial cable; and fastener means for movably engaging the first body means and defining a second cavity having a first opening and a second opening each communicating with the second cavity, the fastener means being coupled onto the connector body means in a first configuration, and the first and second openings of the fastener means allowing for passage of a portion of the coaxial cable, and capable of being coupled onto the connector body means in a second configuration for decreasing the volume of the outer first cavity.

Furthermore, the present invention relates to a connector comprising first body member including an inner member defining an inner first cavity, and further including an outer member coupled to the inner member and defining therebetween an outer first cavity, said inner member having a first opening and a second opening each communicating with said inner first cavity, and said outer member having at least one opening communicating with said outer first cavity; and second body member defining a second cavity and having a first opening and a second opening each communicating with the second cavity, at least a portion of the second body member being disposed on the outer member of the first body member in a first configuration, and capable of being disposed on the outer member in a second configuration in which the volume of the outer first cavity is decreased.

In addition, the present invention is directed to a method of positioning a connector on a coaxial cable, the coaxial cable comprising a center conductor, an insulator core, an outer conductor, and a sheath, comprises preparing an end of the coaxial cable by separating the center conductor and insulator core from the outer conductor and sheath; providing a first body member including a post member defining an inner first cavity, and further including a connector body coupled to the post member and defining an outer first cavity therebetween, the post member having a first opening and a second opening each communicating with the inner first cavity, and the connector body having at least one opening communicating with the outer first cavity; providing a second body member defining a second cavity having a first opening and a second opening each communicating with the second cavity; movably fastening the second body member onto at least a portion of an outer surface of the connector body in a first configuration; inserting the prepared coaxial cable end through the second opening of the second body member and extending the center conductor of the prepared coaxial cable end out of second opening of post member; and moving second body member on connector body to a second configuration so as to decrease the volume of outer first cavity such that the first body member engages the outer conductor and sheath of the coaxial cable.

The step of moving the second body member on the connector body to its second configuration includes forcibly sliding the second body member along the connector body. The step of inserting the prepared end of the coaxial cable further includes advancing the coaxial cable such that the insulator core engages a ridge disposed within post member.

Moreover, the present invention is directed to a coaxial connector for coupling a coaxial cable to a device, the coaxial cable including a center conductor, an insulating core, an outer conductor and a sheath, comprising post member defining an inner first cavity, the post member having a first opening and a second opening each communicating with the inner first cavity; connector body coupled to the post member and defining therebetween an outer first cavity having at least one opening communicating with the outer first cavity; fastener member defining a second cavity and being coupled to the connector body for sliding engagement on the outer surface of the connector body, from a first configuration wherein the fastener member is fastened onto the connector body prior to coupling to the coaxial cable, to a second configuration after the coaxial cable is inserted into the connector and wherein the fastener member coacts with the connector body so that the connector sealingly grips the coaxial cable.

In a preferred embodiment, the fastener member includes an internal groove, and the connector body includes a detent, whereby the internal groove and the detent cooperate such that the fastener member is movably fastened to the connector body in its first configuration. In an alternative embodiment, the fastener member includes a detent, and the connector body includes a notch, whereby the detent and the notch cooperate such that the fastener member is securely fastened to the connector body in its first configuration. In one embodiment, the connector body includes a second notch, whereby the detent and the second notch cooperate such that the fastener member is securely fastened to the connector body in its second configuration. The fastener member has a first inner bore dimensioned so as to deform the connector body in its first configuration, and wherein the fastener member has a second inner bore dimensioned so as to further deform the connector body in its second configuration. The connector body includes a flange positioned to engage the fastener member in the second configuration. The connector further includes a nut member coupled to the post member. The nut member can include a flange positioned to engage the fastener member in the second configuration. The post member includes a protrusion disposed to securely couple with the connector body member. The connector body includes a plurality of annular serrations disposed on an inner surface thereof. The outer surface of the connector body has a plurality of corrugations disposed opposite the plurality of annular serrations.

BRIEF DESCRIPTION OF THE DRAWINGS

The present invention is described in detail below with reference to the drawings in which.

DETAILED DESCRIPTION OF PREFERRED EMBODIMENTS

In the description which follows, any reference to either direction or orientation is intended primarily and solely for purposes of illustration and is not intended in any way as a limitation to the scope of the present invention. Also, the particular embodiments described herein, although being preferred, are not to be considered as limiting of the present invention.

Figure 1:
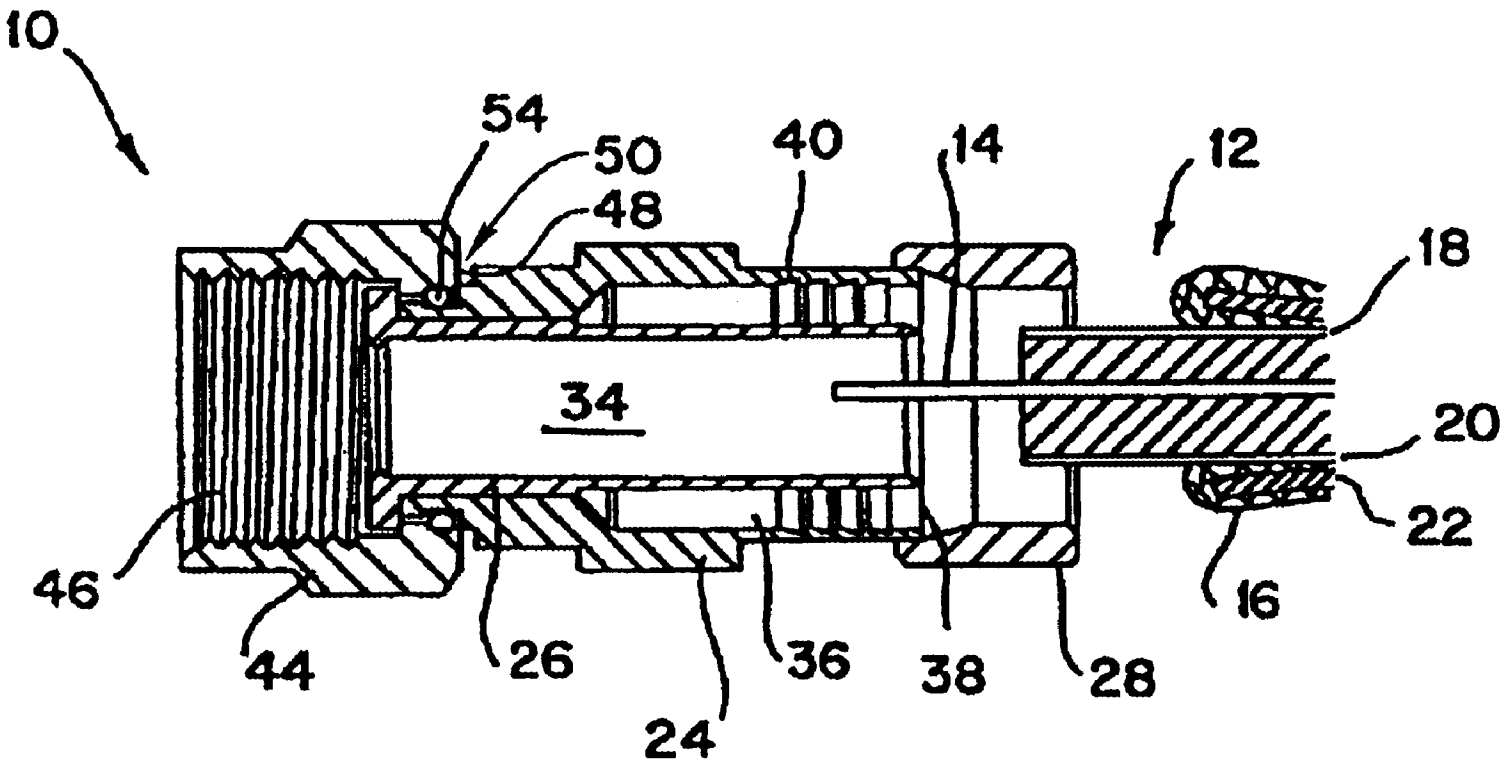
FIG. 1 is a longitudinal cross-sectional view of a preferred embodiment of a connector according to the present invention shown adjacent to the prepared end of a coaxial cable, and wherein the fastener member is in a first configuration.

Referring to FIG. 1, a connector 10 in accordance with one preferred embodiment of the present invention is shown adjacent to the prepared end of a cable 12. In the example illustrated, cable 12 can be a known coaxial type having an electrical center conductor 14 surrounded by and spaced radially inwardly from a braid conductor 16 by a foil 18 and an insulator core 20. A dielectric covering or sheathing jacket 22 surrounds the braid 16 and comprises the outermost layer of the cable. Although an exemplary coaxial cable has been described, the connector 10 of the present invention can also be used with coaxial cables having configurations different from that disclosed above.

An end of the cable is prepared, as shown in FIG. 1, to receive the connector 10 by selectively removing various layers to progressively expose an end of the center conductor 14 and an end of the insulator core 20 and foil 18 as illustrated. An end portion of the braid conductor 16 is folded over sheathing jacket 22.

Referring to one preferred embodiment of the present invention shown in FIGS. 1–4, the connector 10 is configured and dimensioned to accommodate receiving the prepared end of a coaxial cable. The connector 10 has a first body member that includes connector body 24 and post member 26. The connector 10 also has a second body member which as shown in FIGS. 1–4 is fastener member 28. The post 26 preferably is a tubular member having a first opening 30 and a second opening 32. The post 26 defines a first inner cavity 34. The inner surface of connector body 24 is radially spaced about the post 26 to define a first outer cavity 36 accessible via opening 38 at one end of the connector body 24. The first outer cavity 36 is closed at the other end of connector body 24 together with post member 26.

Preferably, the connector body 24 and the post member 26 are separate components wherein the connector body 24 is press fitted onto the outer surface of the post member 26. In this preferred embodiment, the connector body 24 is preferably formed of brass or a copper alloy and the post member is formed of brass. In an alternative preferred embodiment, the connector body 24 and post member 26 can be formed integrally as a single piece. Also, the connector body 24 can be formed of a plastic composition.

Advantageously, the inner surface of the connector body 24 has annular serrations 40 disposed opposite the post member 26. Similar serrations are illustrated and described in U.S. Pat. No. 5,073,129 (Szegda) which is incorporated herein in its entirety. As discussed in more detail below, the post member 26 and annular serrations 40 of the connector body 24 provide for a continuous environmental seal and grip on the braid 16 and sheathing jacket 22 of the cable when the fastener member 28 is in its second configuration.

Figure 6:
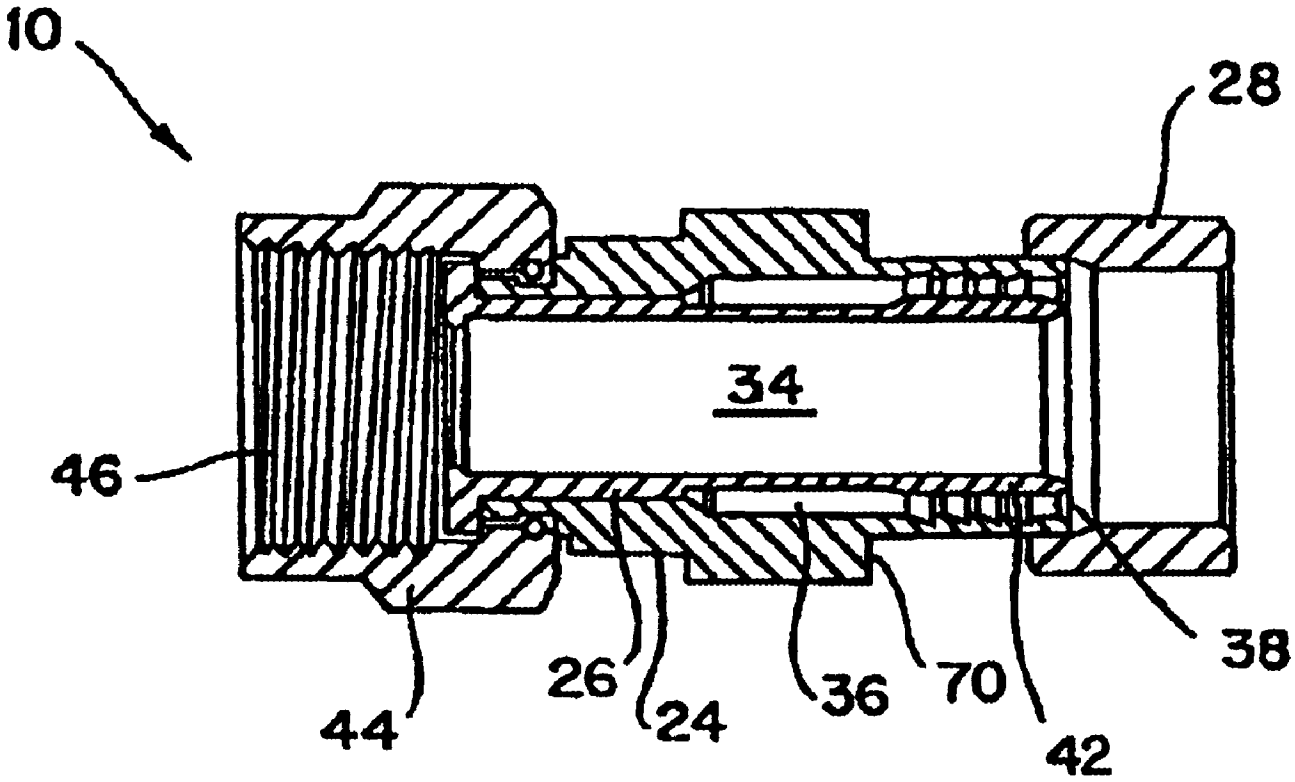
FIG. 6 is a longitudinal cross-sectional view of another preferred embodiment of a connector according to the present invention wherein the post member has an enlarged portion, and wherein the fastener member is in a first configuration.

Referring to FIG. 6, in another alternative preferred embodiment, the outer surface of the post member 26 can be configured with a radially enlarged portion 42 within the first outer cavity 36 at a location proximate to opening 38. Similar to the embodiment of FIG. 1, the radially enlarged portion 42 of the post member and annular serrations 40 of the connector body cooperate to provide for a continuous environmental seal and grip on the braid and sheathing jacket of the cable when the fastener member 28 is in its second configuration.

Figure 3:
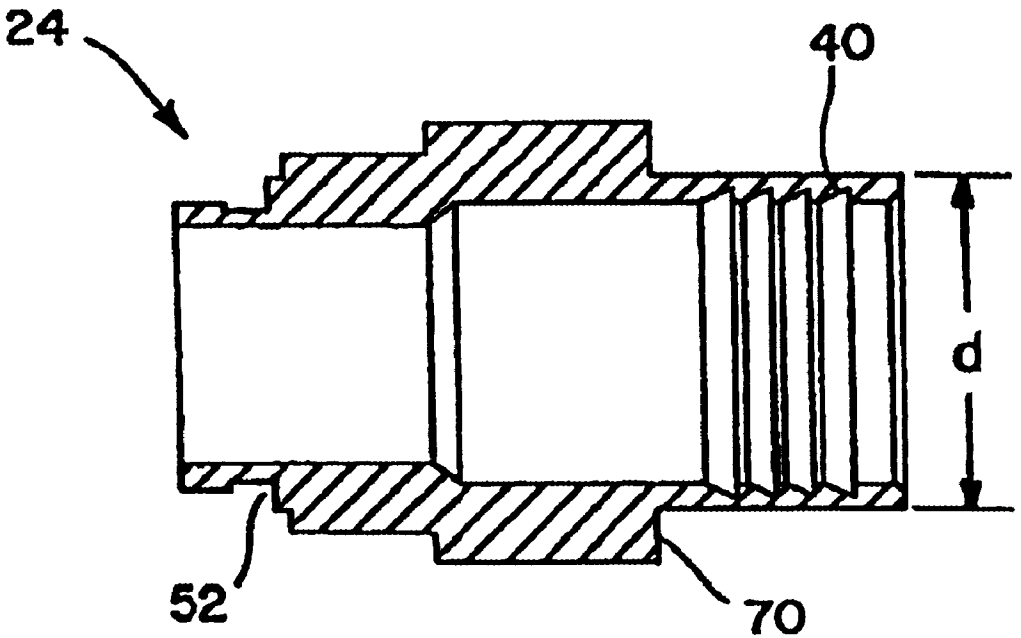
FIG. 3 is a longitudinal cross-sectional view of the connector body of the connector of FIG. 1.
Figure 5:
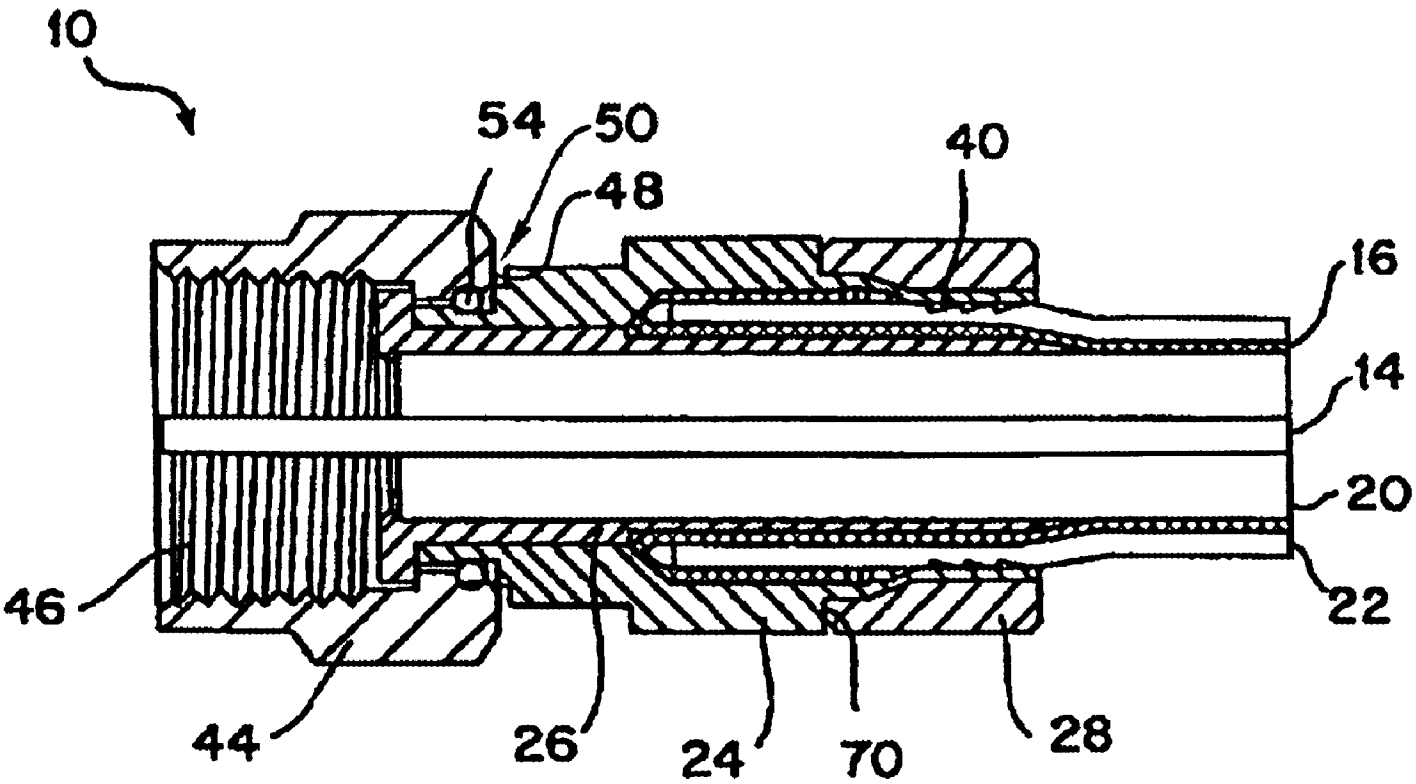
FIG. 5 is a longitudinal cross-sectional view of the connector of FIG. 1 with the fastener member in a second configuration.

As illustrated in FIGS. 1, 3, and 5, the nut member 44 is internally threaded as at 46 and is provided with a shoulder 48 seated in groove 50 formed by the outer surface of the base of post 26 and groove 52 of the connector body 24. The nut 44 and post 26 are rotatable. An O-ring seal 54 can be seated in groove 52 of connector body 24 to serve as a moisture barrier.

Figure 4:
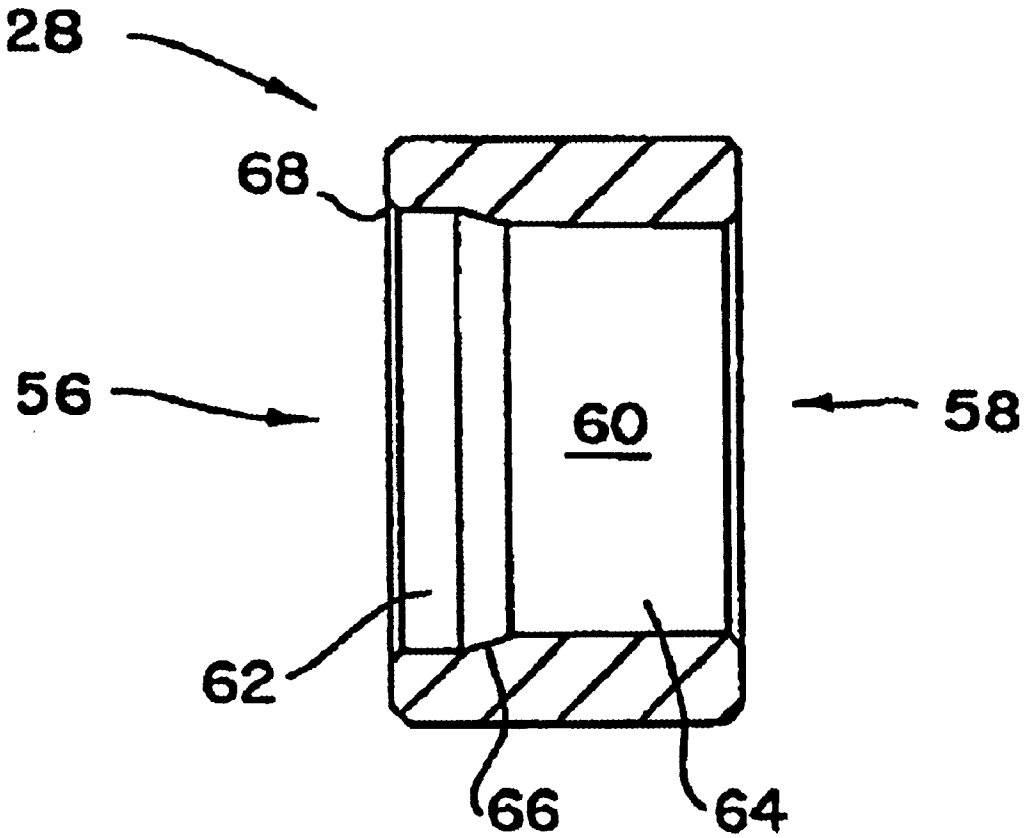
FIG. 4 is a longitudinal cross-sectional view of the fastener member of the connector of FIG. 1.

Fastener member 28 is shown in FIGS. 1 and 4 as being preferably of a tubular configuration. The fastener member 28 is preferably formed of steel with an electroless nickel/teflon finish, and has a first opening 56 and a second opening 58 which define a second cavity 60. The fastener member 28 includes a first inner bore 62 having a first diameter, and a second inner bore 64 having a second diameter which is less than the diameter of the first bore. The first inner bore 62 has a first diameter which is a constant diameter internal bore or a non-tapered internal bore. A ramped surface 66 is provided between the first. 62 and second 64 bores. Also, at first inlet opening 56, a slight flare 68 extending from the first bore to inlet opening 56 is preferably provided to allow the fastener member 28 to be fastened onto the connector body 24. Although the fastener member 28 can be coupled to the connector body 24 such that the fastener member 28 can be removed by hand, in the embodiments illustrated in FIGS. 1 and 4, the fastener member 28 is dimensioned and configured relative to the dimensions of the connector body 24 so that the fastener member 28 is securely attached to the connector body 24. Such attachment can be obtained by a press fit assembly. As described herein, the fastener member 28 is movably coupled to the connector body 24 so as to be capable of being moved on the connector body 24 from a first preassembled configuration to a second assembled configuration. The fastener member or compression ring 28 is not attached to a threaded member, but is axially slidably engaged with the connector body 24. Both the first inner bore 62 and the second inner bore 64 have diameters which are less than an outer diameter d of the portion of the connector body that accepts the fastener member 28.

In a pre-installed first configuration as illustrated in FIG. 1, the fastener member 28 is fastened onto the connector body 24 such that the first bore 62 is securely attached to the connector body 24, and such that the connector body 24 is gripped to affect a corresponding decrease in the volume of the first outer cavity 36. Thus, the connector body 24 is pushed radially inwardly towards the outer surface of the post 26. In this manner, the fastener member 28, in its pre-installed first configuration, is securely fastened to the connector body 24 and is thus in an assembled state during storage, handling, and installation on a cable end. This eliminates any danger of the fastener member 28 being dropped or otherwise mishandled during handling and installation as is prevalent in known designs.

The second configuration shown in FIG. 5 is achieved after the fastener member 28 is axially moved along the connector body 24 to a second location on the connector body 24 such that the second inner bore 64 of the fastener member 28 engages the outer surface of the connector body 24. As shown in FIGS. 3 and 5, flange 70 on the connector body 24 is preferably provided to engage the fastener member 28 at its second configuration. In this preferred embodiment, flange 70 may be a tubular ring or a portion thereof as shown. Alternatively, however, flange 70 can be formed of one or more protrusions from the outer surface of the connector body 24 at one or more locations.

A method of positioning the connector on a coaxial cable is now described with reference to FIGS. 1 and 5. The end of a coaxial cable is prepared by exposing a central core portion including the center conductor 14, insulator core 20, and foil 18. The outer braid conductor 16 is foldedover the end of the outer sheath jacket 22. The prepared end of the coaxial cable can be inserted through the second opening of fastener member 28 such that the central core portion including the center conductor 14, insulator core 20, and foil 18 is inserted into the first inner cavity 34 of post member 26. Also, the outer portion of the cable including outer braid conductor 16 folded over the end of the outer sheath jacket 22 is received into the first outer cavity 36 through opening 38.

Figure 2:
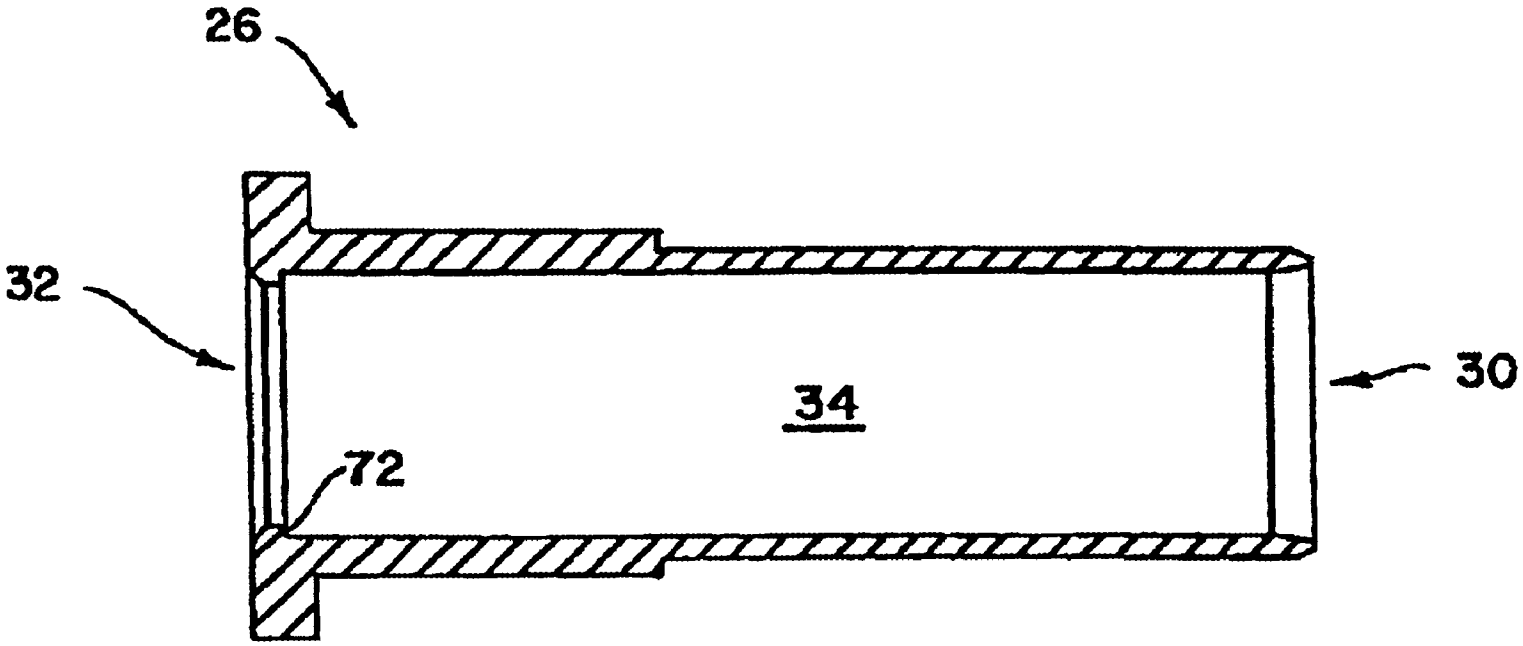
FIG. 2 is a longitudinal cross-sectional view of the post member of the connector of FIG. 1.

Advantageously, as illustrated in FIG. 2, an internal ridge 72 is provided within the first inner cavity 34 of the post member adjacent second opening 32. The ridge 72 is positioned such that the exposed end of the center conductor 14 protrudes beyond the second opening 32 of the post member 26, while the insulator core portion and foil of the cable is prevented from being displaced through second opening 32 of the post member 26.

Once the insulator core portion of the cable is positioned to abut ridge 72 of the post member 26, the fastener member 28 is then advanced or moved axially from its pre-installed first configuration to its second configuration by a standard tool. As discussed above, in the preferred embodiment, the fastener member 28 engages flange 70 of the connector body 24 in its second configuration.

Since the diameter of the second inner bore 64 of fastener member 28 is smaller than the diameter d, shown in FIG. 3, of the portion of the connector body 24 accepting the fastener member 28, the connector body is concentrically gripped so that the volume of the outer first cavity is further decreased. That is, the connector body 24 is further displaced or moved and compressed radially inwardly to decrease the volume of the first outer cavity 36 or first central bore when the fastener member 28 is slidingly moved from the first pre-installed configuration toward the second end of the connector body 24. As a result, the outer portion of the cable is firmly gripped or clamped between the outer surface of post member 26 and connector body 24. In this manner, in the preferred embodiment, the post member 26 cooperates with the annular serrations 40 of the connector body to provide a generally continuous, 360° seal and grip on the outer portion of the cable. In an alternative embodiment as shown in FIG. 6, the flared portion 42 of post member 26 cooperates with the annular serrations 40 of the connector body 24 in a similar manner. Advantageously, both of these constructions eliminate the need for an O-ring or other seal between the connector body 24 and the fastener member 28, and can accommodate a wide range of cable types and sizes. Thus the need for connectors of various sizes can be avoided with a universal connector of the present invention.

Once the fastener member 28 is in its second configuration, nut 44 may then be employed to attach the connector to a system component—typically a threaded port or the like.

Figure 7:
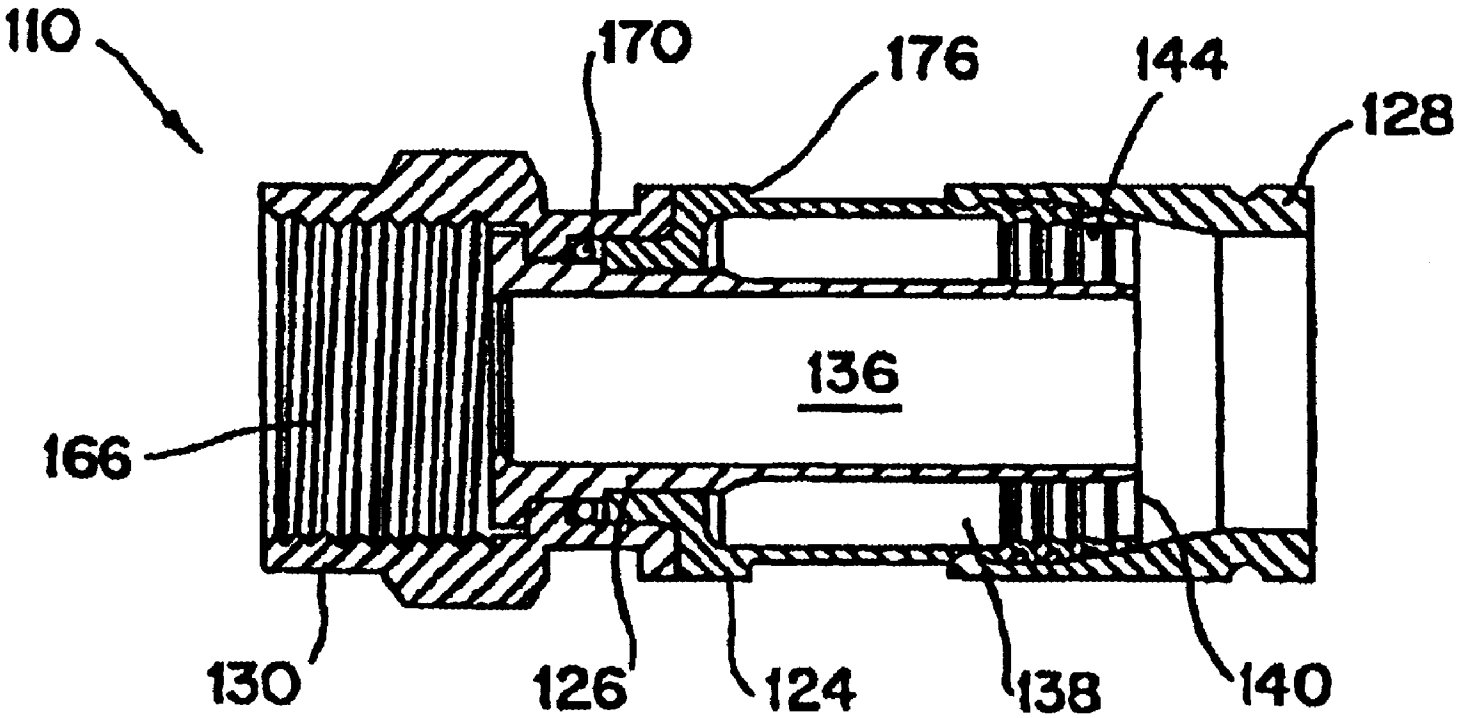
FIG. 7 is a longitudinal sectional view of yet another preferred embodiment of a connector according to the present invention wherein the fastener member is in a first configuration.
Figure 12:
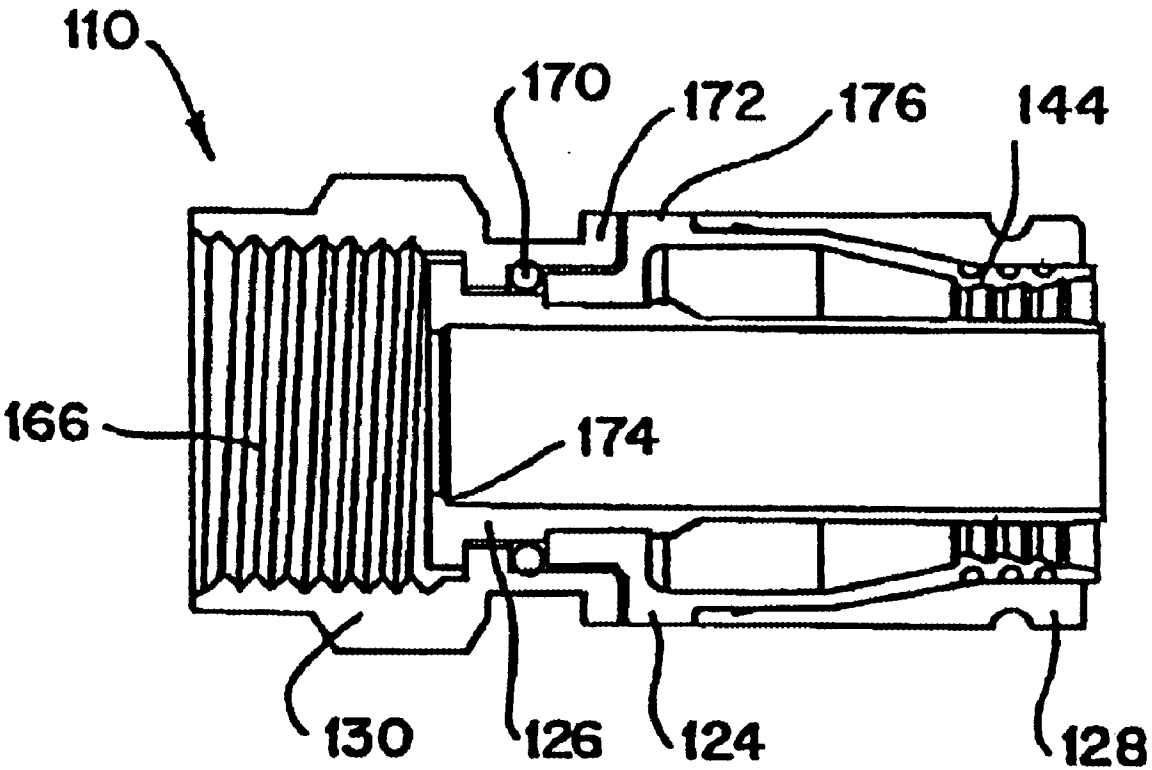
FIG. 12 is a longitudinal cross-sectional view of the connector of FIG. 7 with the fastener member in a second configuration.
Figure 13:
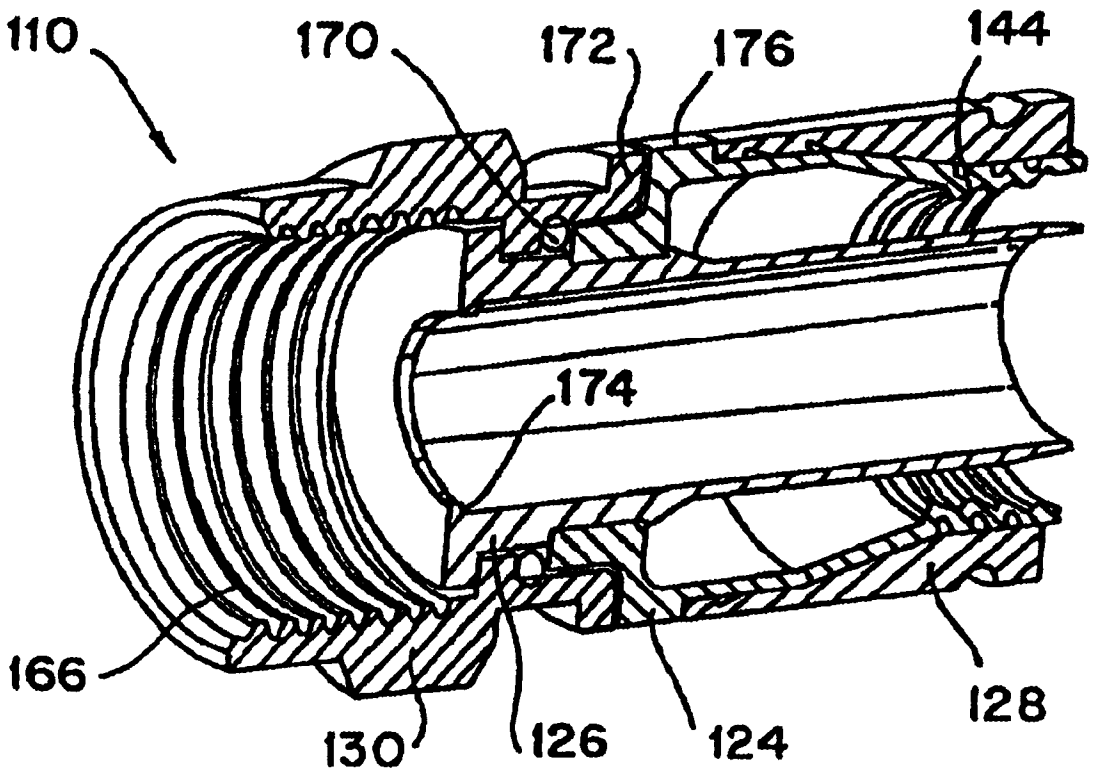
FIG. 13 is a perspective sectional view of the connector of FIG. 7 with the fastener member in a second configuration.
Figure 21:
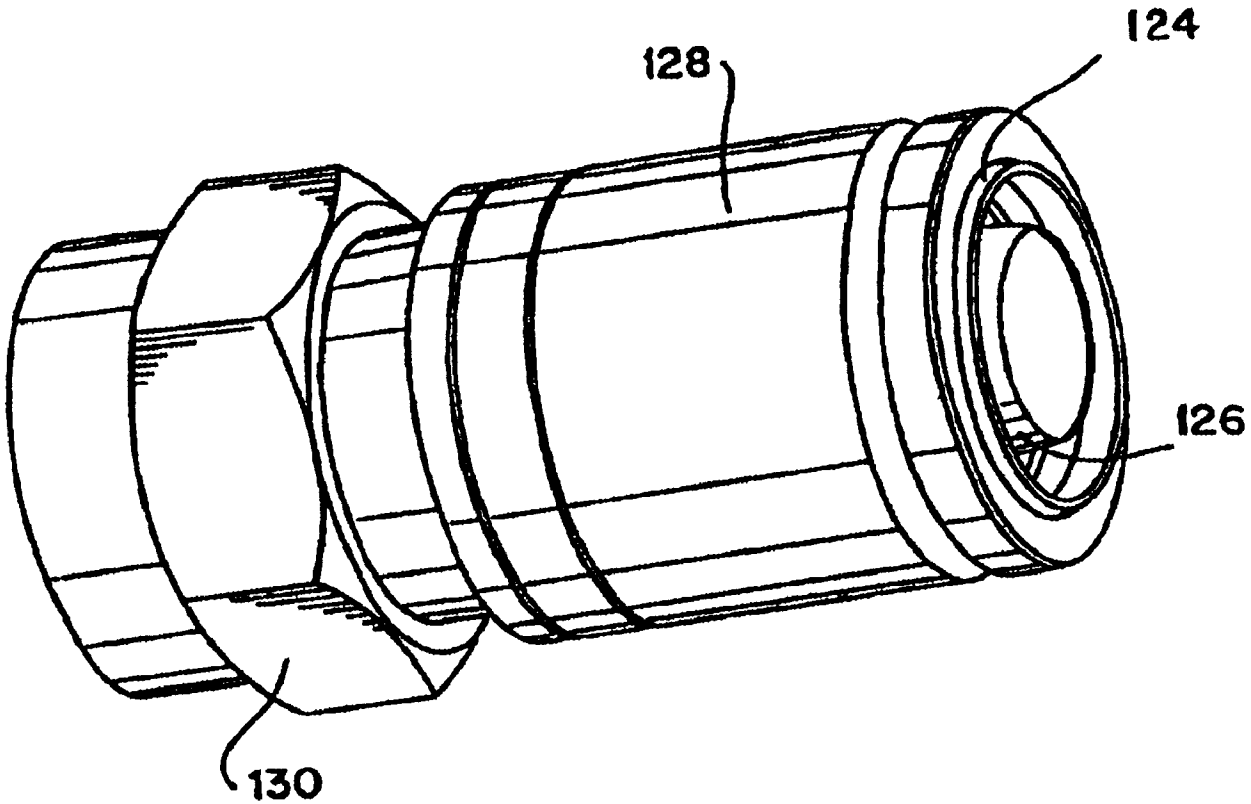
FIG. 21 is a perspective view of the connector of FIG. 7 with the fastener member in a second configuration.

Referring to FIGS. 7–13 and FIG. 21 which illustrate yet another alternative embodiment, the connector 110 includes a connector body 124, a post member 126, a fastener member 128, and a nut member 130. FIG. 7 shows the connector with the fastener member 128 in its first configuration, while FIGS. 12–13 and FIG. 21 show the connector 110 with the fastener member 128 in its second configuration.

Figure 8:
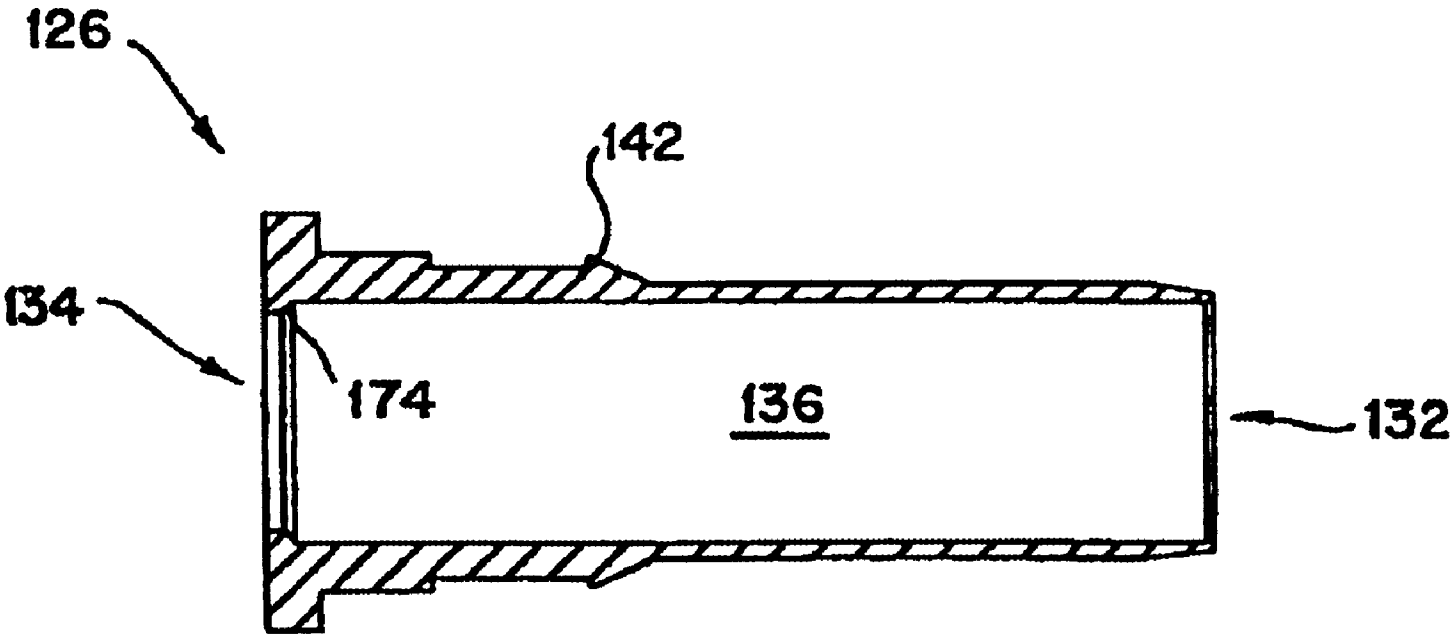
FIG. 8 is a longitudinal cross-sectional view of the post member of the connector of FIG. 7.

Similar to the connector of FIGS. 1–6, post member 126, which preferably is formed of brass, includes an inner tubular member having a first opening 132 and a second opening 134. The post member 126 defines a first inner cavity 136. The inner surface of connector body 124 is radially spaced from post member 126 to define a first outer cavity 138 accessible via opening 140. The first outer cavity 138 is closed at its far end by post member 126 and connector body 124. As illustrated in FIGS. 7–8, post member 126 can also include a protrusion 142 on its outer annular surface for engaging the connector body 124, which is otherwise attached to the post member by an interference fit, to insure a secured attachment with the connector body 124.

Like the connector body of the connector of FIGS. 1–6, the inner surface of connector body 124 has annular serrations 144 disposed opposite the post member. The post member 126 and annular serrations 144 of the connector body 124 provide for a generally continuous environmental seal and grip on the braid 16 and sheathing jacket 22 of the cable when the fastener member is in its second configuration. In this embodiment, the connector body is preferably comprised of a plastic such as DELRIN™.

Figure 9:
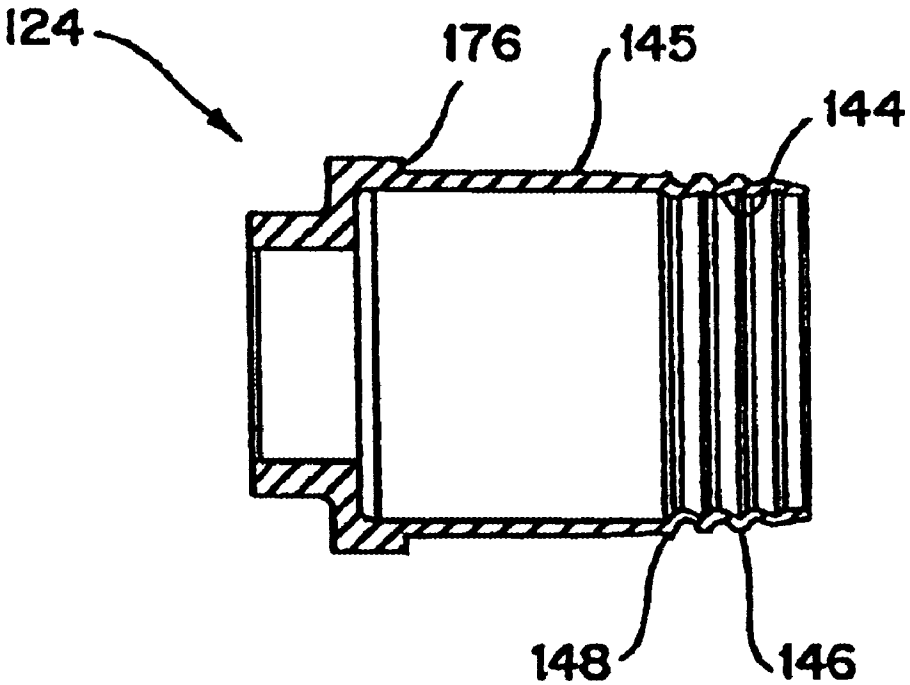
FIG. 9 is a longitudinal cross-sectional view of the connector body of the connector of FIG. 7.

As shown in FIG. 9, the connector body wall tapers as at 145 to facilitate the generally radial movement of the connector body 124 when the fastener member 128 is moved into its second configuration. The connector body 124 can also include a corrugated surface portion 146 opposite annular serrations 144. This corrugated surface portion is believed to reduce the driving force needed to move or slide fastener member 128 along connector body 124. Also, the connector body 124 can include a detent 148 disposed on its outer surface to cooperate with an internal groove 150 of the fastener member to insure that the fastener member 128 is fastened to the connector body 124 in its first configuration. The detent 148 can be a ring like protrusion or can be formed of discrete protrusions about the connector body.

Figure 10:
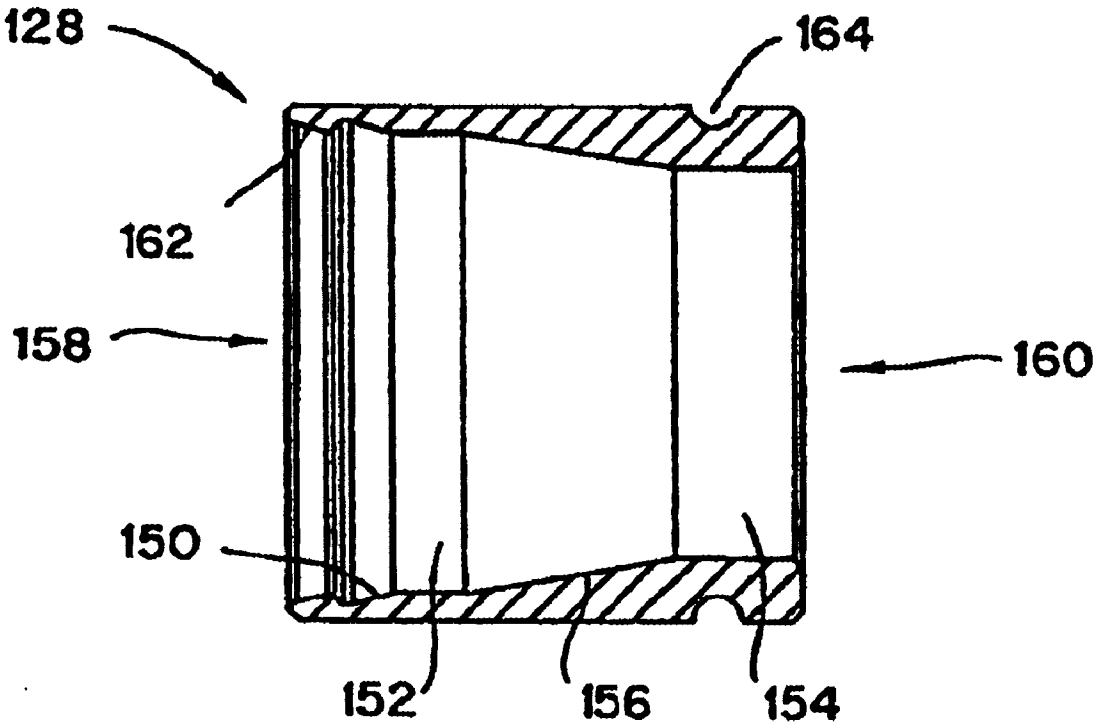
FIG. 10 is a longitudinal cross-sectional view of the fastener member of the connector of FIG. 7.
Figure 11:
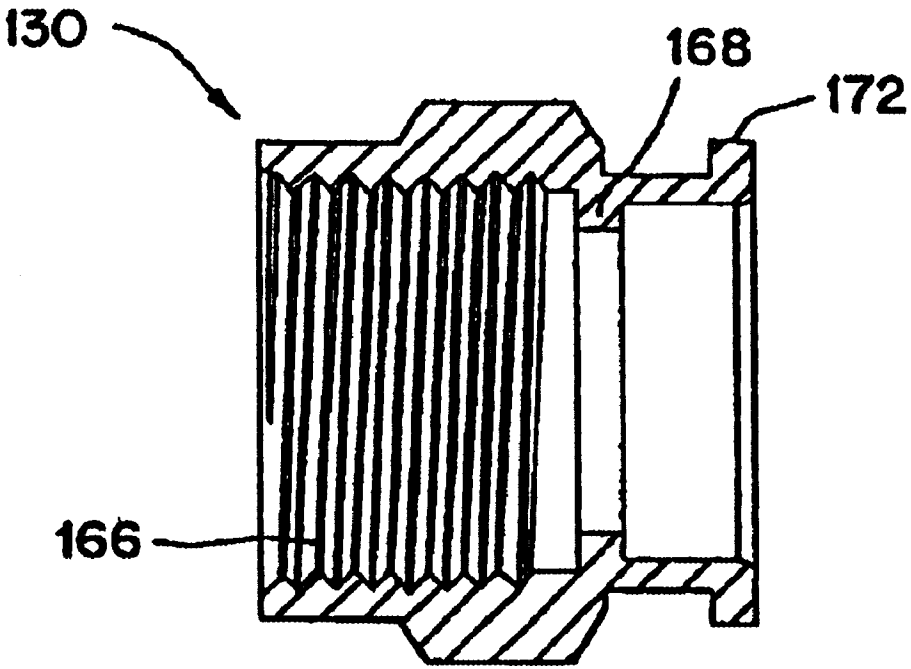
FIG. 11 is a longitudinal cross-sectional view of the nut member of the connector of FIG. 7.

Referring to FIGS. 7 and 10, fastener member 128, which preferably is formed of brass, includes a first inner bore 152 having a first diameter and a second inner bore 154 having a second diameter which is less than the diameter of the first bore. A ramped surface 156 is provided between the first and second bores. Fastener member 128 has a first opening 158 adjacent the first inner bore and a second opening 160 adjacent the second inner bore. A flared inner portion 162 is provided at the first opening to facilitate sliding of the fastener member along the connector body.

Fastener member 128 also includes internal groove 150 adjacent first opening 158. As discussed above, this internal groove cooperates with detent 148 of the connector body to insure that the fastener member is securely fastened to the connector body in its first configuration as shown in FIG. 7. Fastener member may also include a notch 164 on its outer annular surface for assembly line purposes. This notch is not critical to the operation of the connector.

The first inner bore 152 may be dimensioned so as to radially compress the connector body inwardly when the fastener member is in its first configuration. Alternatively, the first inner bore 152 may be dimensioned to simply provide a press fit between the fastener member and the connector body when the fastener member is in its first configuration. In any event, in both of these constructions, the detent 148 of the connector body and the internal groove 150 of the fastener member cooperate to insure that the fastener member is securely fastened to the connector body in its first configuration.

The second inner bore 154 is dimensioned to compress the connector body radially inwardly when the fastener member is in its second configuration. Of course, where the first inner bore is dimensioned to radially compress the connector body member radially inwardly when the fastener member is in its first configuration, the second inner bore would further compress the connector body radially inwardly when the fastener member is in its second configuration.

As illustrated by FIGS. 7, 11, 12, and 13, nut member 130 is internally threaded as at 166 and is provided with a first shoulder 168 seated in a groove formed by the base of post member 126 and connector body 124. An O-ring seal 170 may be seated between the post member, the connector body, and the nut member to serve as a moisture barrier. The nut member also preferably includes second shoulder 172. Second shoulder 172 reinforces the connector body and may be used as a surface for the tool utilized to forcibly slide the fastener member along the connector body.

A method of positioning the connector of FIGS. 7–13 on a coaxial cable is now described. The end of a coaxial cable is prepared as discussed above with respect to the end connector of FIGS. 1–6. Then, the prepared end of the coaxial cable is inserted through the second opening of the fastener member such that the central core portion comprising the center conductor 14, insulator core 20, and foil 18 is inserted into the first inner cavity 136 of post member 126 just as discussed above with respect to the connector of FIGS. 1–6. Also, the outer portion of the cable comprising outer braid conductor 16 folded over the end of the outer sheath jacket 22 is received into the first outer cavity 138 through opening 140.

The insulator core and foil of the cable is then axially displaced within the post member to ridge 174. The ridge is positioned such that the exposed end of the center conductor 14 protrudes beyond second opening 134 of the post member, while the insulator core portion 20 and foil 18 of the cable is prevented from being displaced through second opening 134 of the post member.

Once the insulator core and foil of the cable is positioned to abut ridge 174 of the post member, the fastener member is then advanced or moved axially from its pre-installed first configuration to its second configuration by a standard tool. In this second configuration, the fastener member engages flange 176 of the connector body which acts as a positive stop.

As discussed above, the second inner bore 154 of the fastener member is dimensioned to concentrically compress the connector body so that the volume of the outer first cavity 138 is decreased. That is, the connector body is deformed radially inwardly. As a result, the outer portion of the cable is firmly clamped between the outer surface of post member 126 and connector body 124. In this manner, in the preferred embodiment, the post member cooperates with the annular serrations 144 of the connector body to provide a generally continuous, 360° seal and grip on the outer portion of the cable. Advantageously, like the connector of FIGS. 1–6, this construction eliminates the need for an O-ring or other seal between the connector body and the fastener member, and can accommodate a wide range of cable types and sizes.

Once the fastener member is in its second configuration, nut 130 may then be employed to attach the connector to a system component—typically a threaded port or the like.

Figure 14:
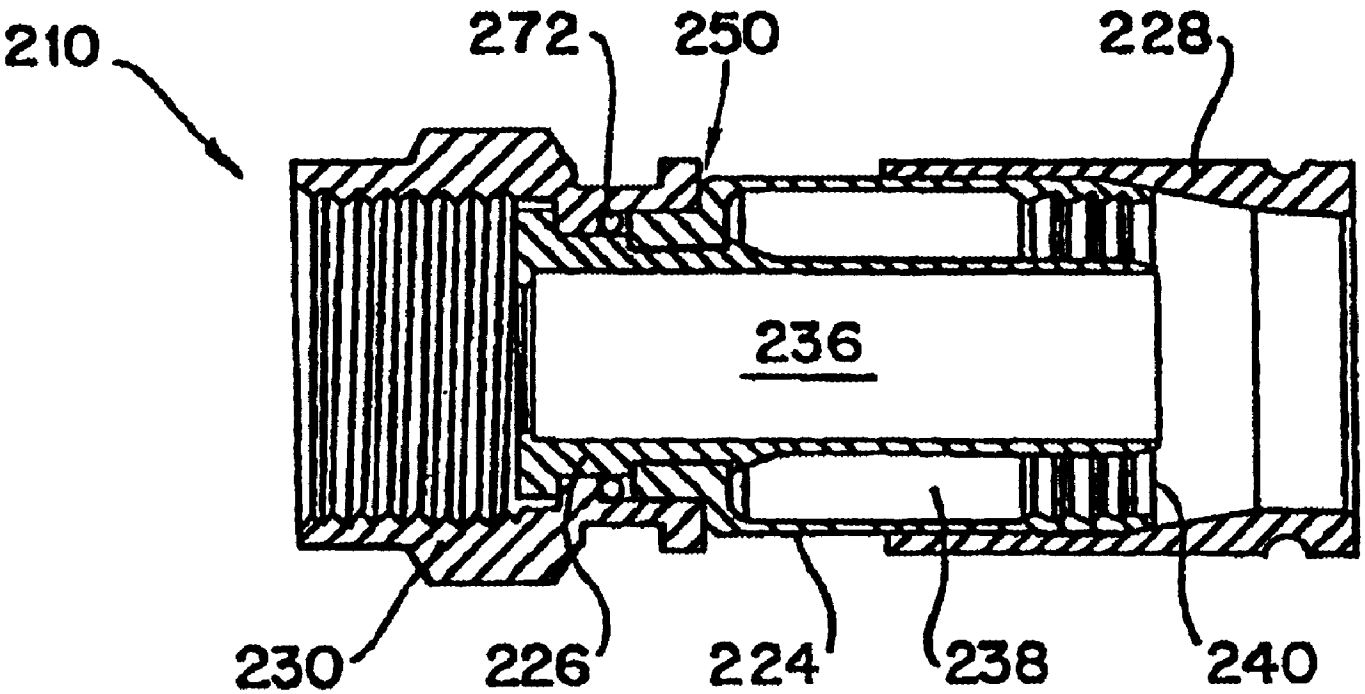
FIG. 14 is a longitudinal sectional view of still another preferred embodiment of a connector according to the present invention wherein the fastener member is in a first configuration.
Figure 17:
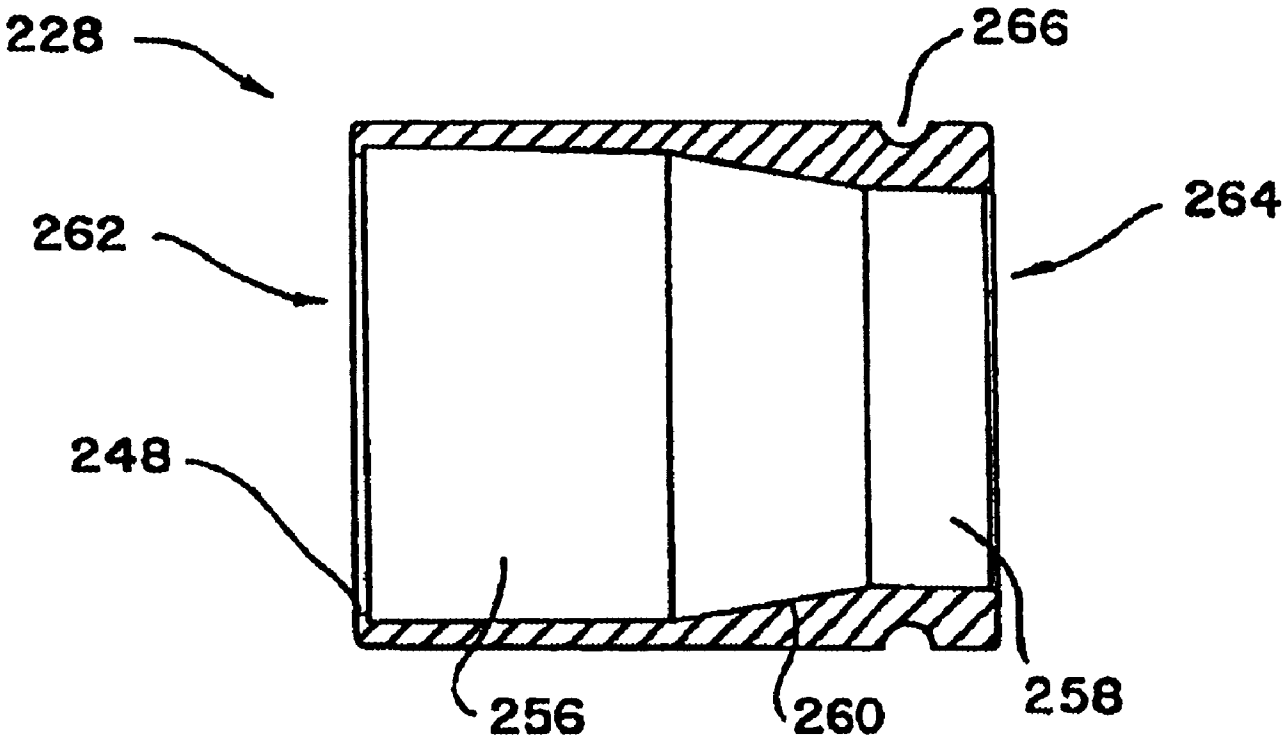
FIG. 17 is a longitudinal cross-sectional view of the fastener member of the connector of FIG. 14.
Figure 18:
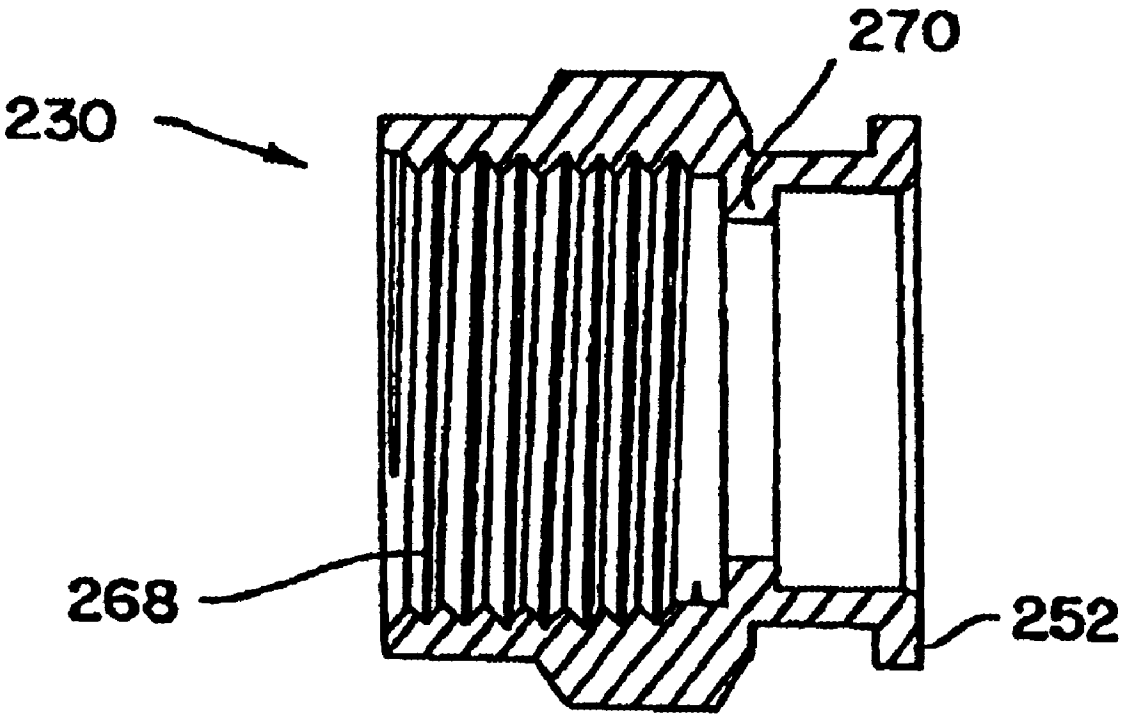
FIG. 18 is a longitudinal cross-sectional view of the nut member of the connector of FIG. 14.
Figure 19:
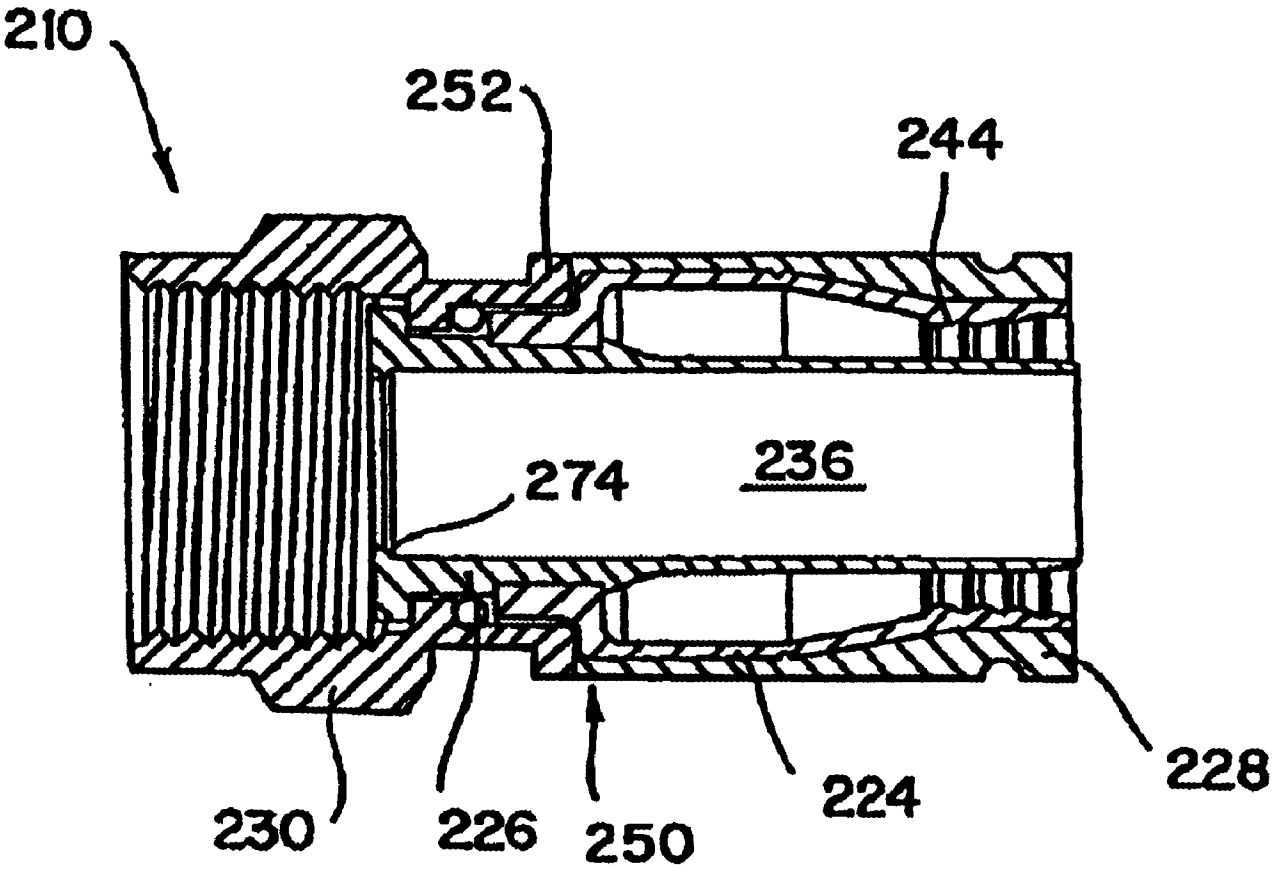
FIG. 19 is a longitudinal cross-sectional view of the connector of FIG. 14 with the fastener member in a second configuration.
Figure 20:
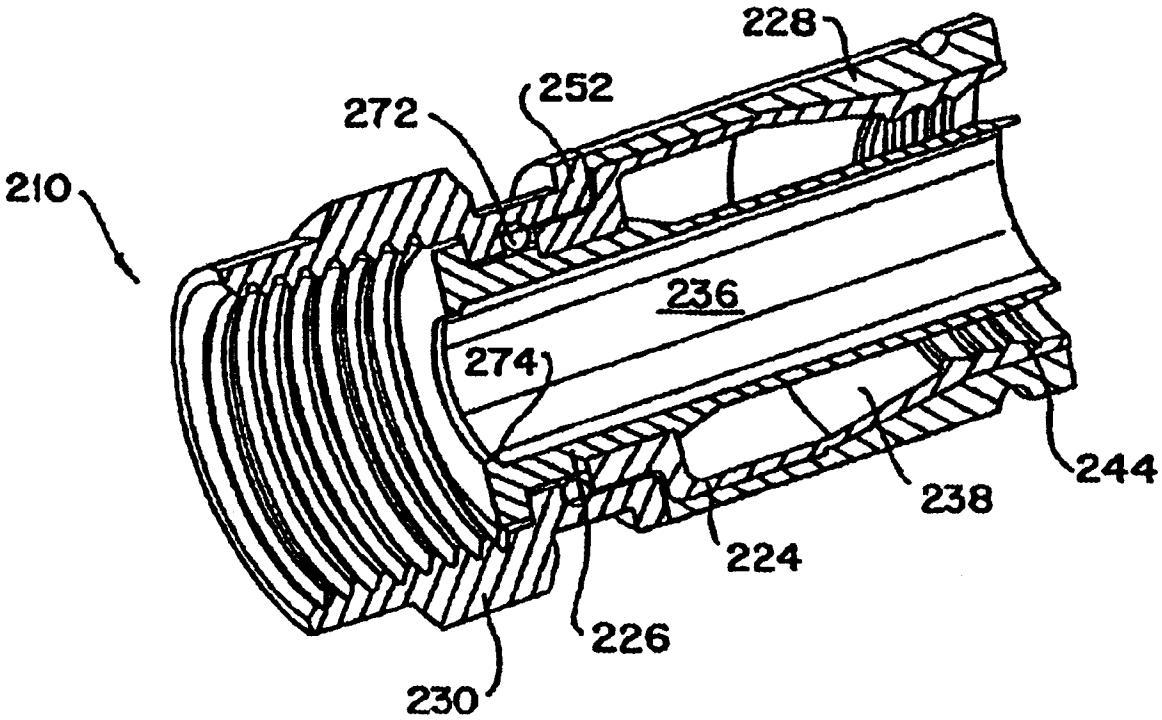
FIG. 20 is a perspective cross-sectional view of the connector of FIG. 14 with the fastener member in a second configuration.
Figure 22:
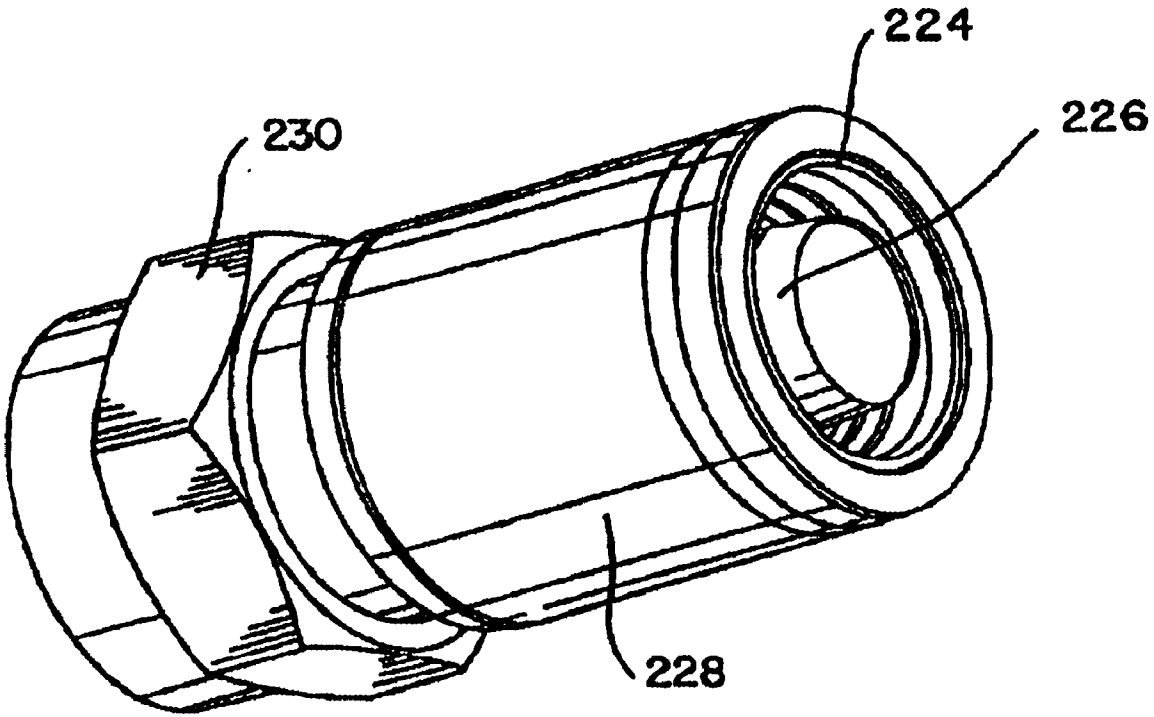
FIG. 22 is a perspective view of the connector of FIG. 14 with the fastener member in a second configuration.

Referring to FIGS. 14–20 and FIG. 22, which illustrate still another alternative embodiment, connector 210 includes a connector body 224, a post member 226, a fastener member 228, and a nut member 230. FIG. 14 shows the connector with the fastener member in its first configuration, while FIGS. 19–20 and FIG. 22 show the connector with the fastener member in its second configuration.

Figure 15:
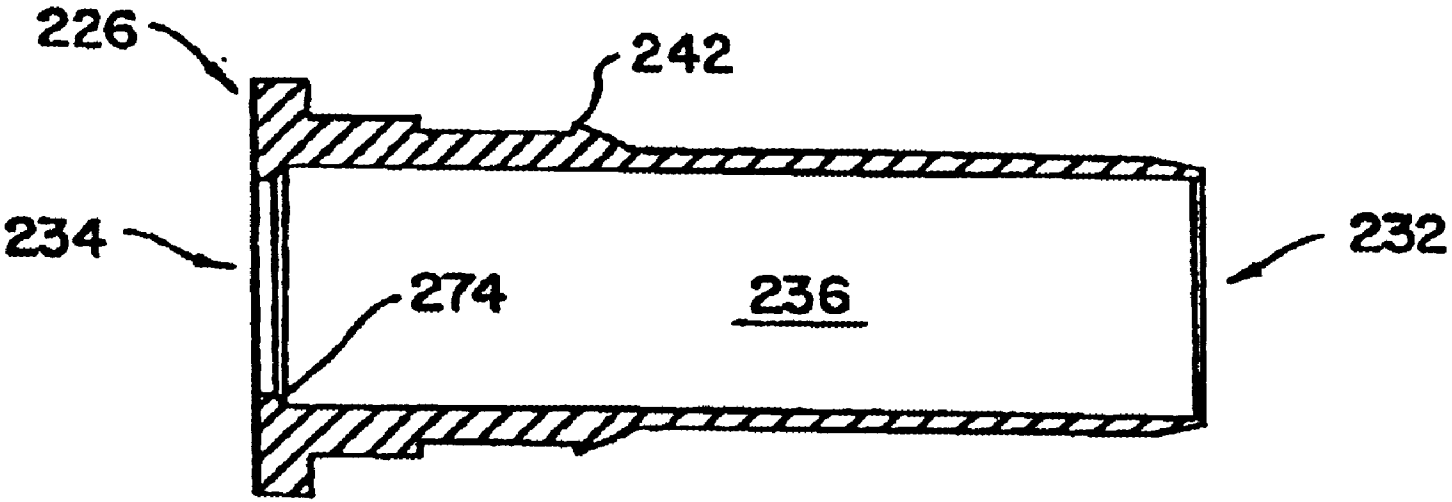
FIG. 15 is a longitudinal cross-sectional view of the post member of the connector of FIG. 14.

Similar to the connector of FIGS. 1–6, post member 226, which is preferably formed of brass, includes an inner tubular member having a first opening 232 and a second opening 234. The post member defines a first inner cavity 236. The inner surface of connector body cooperates in a radially spaced relationship with the post member to define a first outer cavity 238 accessible via opening 240. The first outer cavity 238 is closed at its far end by post member 226 and connector body 224. As illustrated in FIGS. 14 and 15, post member may also include a protrusion 242 on its outer surface for engaging the connector body, which is otherwise attached to the post member by an interference fit, to insure a secured coupling with the connector body.

Like the connector body of the end connector of FIGS. 1–6, the inner surface of connector body preferably includes annular serrations 244 disposed opposite the post member. The post member and annular serrations 244 of the connector body provide for a generally continuous environmental seal and grip on the braid 16 and sheathing jacket 22 of the cable when the fastener member is in its second configuration. In this embodiment, the connector body is preferably comprised of a plastic such as DELRIN™.

Figure 16:
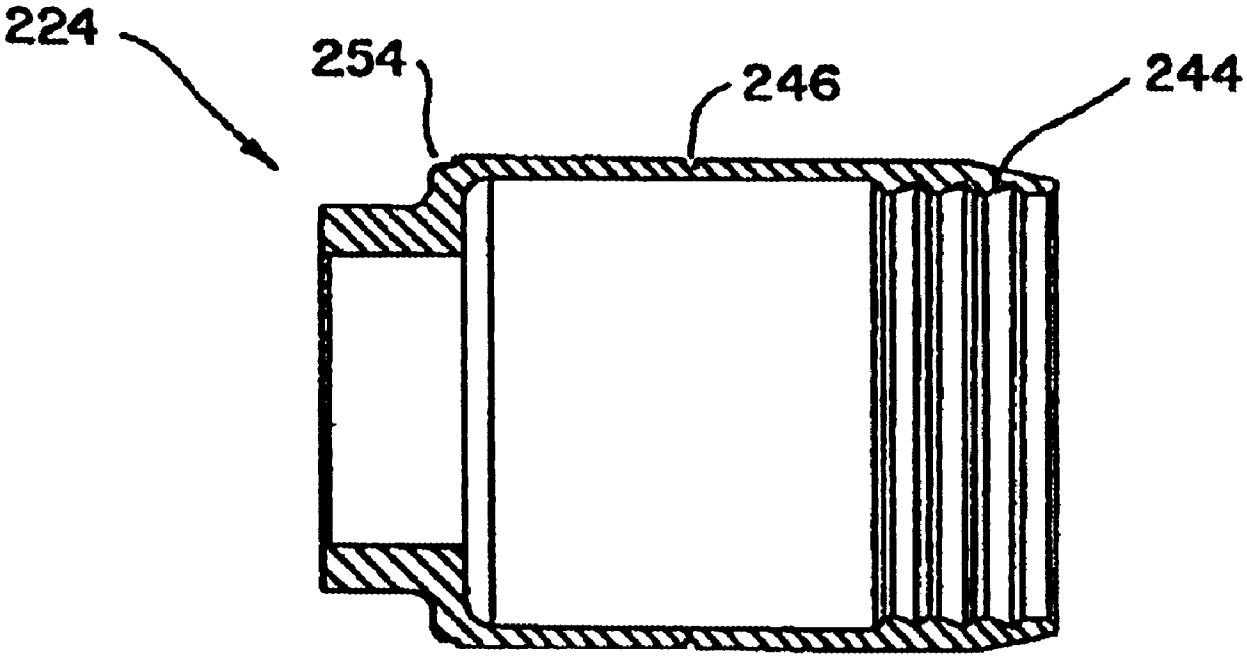
FIG. 16 is a longitudinal cross-sectional view of the connector body of the connector of FIG. 14.

Referring to FIGS. 16 and 17, connector body 224 also may include a first notch 246 disposed on its outer surface for accepting a detent 248 of fastener member 228 to insure that the fastener member is securely fastened to the connector body in its first configuration. As shown in FIGS. 14 and 16, the outer surface of the connector body 224 includes a slight taper at its first end to facilitate insertion of the connector body 224 into the fastener member 228. Moreover, as illustrated in FIGS. 14, 16, and 18, a groove 250 may be formed between a second shoulder 252 of the nut member and a second notch 254 on connector body 224 such that the groove 250 accepts detent 248 of the fastener member in its second configuration. However, this groove may be eliminated such that the fastener member simply abuts the positive stop provided by second shoulder 252 of the nut member when the fastener member is in its second configuration.

Referring to FIG. 17, similar to the fastener members shown in FIGS. 4 and 10, fastener member 228 is preferably formed of brass and includes a first inner bore 256 having a first diameter and a second inner bore 258 having a second diameter which is less than the diameter of the first bore. A ramped surface 260 is provided between the first and second bores. Also, fastener member has a first opening 262 adjacent the first inner bore and a second opening 264 adjacent the second inner bore.

Fastener member also includes detent 248 extending inwardly at its first opening 262. As discussed above, this detent cooperates with notch 246 of connector body to insure that the fastener member is securely fastened to the connector body in its first configuration as shown in FIG. 14. Fastener member may also include a notch 266 on its outer annular surface for assembly line purposes. This notch is not critical to the operation of the connector.

The first inner bore 256 may be dimensioned so as to radially compress the connector body inwardly when the fastener member is in its first configuration. Alternatively, the first inner bore 256 may be dimensioned to simply provide a press fit between the fastener member and the connector body when the fastener member is in its first configuration. In any event, in both of these constructions, detent 248 of the fastener member cooperates with notch 246 of the connector body to insure that the fastener member is securely fastened to the connector body in its first configuration.

The second inner bore 258 of fastener member 228 is dimensioned to compress the connector body radially inwardly when the fastener member is in its second configuration. Of course, where the first inner bore 256 is dimensioned to radially compress the connector body member radially inwardly when the fastener member is in its first configuration, the second inner bore 258 would further compress the connector body radially inwardly when the fastener member is in its second configuration.

As illustrated by FIGS. 14 and 18, nut member 230 is internally threaded as at 268 and is provided with a first shoulder 270 seated in a groove formed by the base of post member 226 and connector body 224. An O-ring seal 272 may be seated between the post member, the connector body, and the nut member to serve as a moisture barrier. The nut member also preferably includes second shoulder 252. Second shoulder 252 reinforces the connector body and may be used as a surface for the tool utilized to forcibly slide the fastener member along the connector body.

A method of positioning the connector of FIG. 14 on a coaxial cable is now described with reference to FIGS. 14–20 and FIG. 22. The end of a coaxial cable is prepared as discussed above with respect to the connector of FIGS. 1–6. Then, the prepared end of the coaxial cable is inserted through the second opening 264 of fastener member 228 such that the central core portion comprising the center conductor 14, insulator core 20, and foil 18 is inserted into the first inner cavity 236 of post member 226. Also, the outer portion of the cable comprising outer braid conductor 16 folded over the end of the outer sheath jacket 22 is received into the first outer cavity 238 through opening 240.

The insulator core 20 and foil 18 of the cable is then axially displaced within the post member to ridge 274. The ridge is positioned such that the exposed end of the center conductor 14 protrudes beyond the second opening 234 of the post member, while the insulator core 20 portion and foil 18 of the cable is prevented from being displaced through second opening 234 of the post member.

Once the insulator core and foil of the cable is positioned to abut ridge 274 of the post member, the fastener member 228 is then advanced axially from its pre-installed first configuration to its second configuration by a standard tool. In this second configuration, the detent 248 of the fastener member can be secured by groove 250 formed between the nut member and the connector body.

As discussed above, the second inner bore 258 of fastener member 228 is dimensioned to concentrically compress the connector body so that the volume of the outer first cavity is decreased. That is, the connector body is deformed radially inwardly. As a result, the outer portion of the cable is firmly clamped between the outer surface of post member 226 and connector body 224. In this manner, in the preferred embodiment, the post member cooperates with the annular serrations 244 of the connector body to provide a generally continuous, 360° seal and grip on the outer portion of the cable. Advantageously, like the connector of FIGS. 1–6, this construction eliminates the need for an O-ring or other seal between the connector body and the fastener member, and can accommodate a wide range of cable types and sizes.

Once the fastener member is in its second configuration, nut 230 may then be employed to attach the connector to a system component—typically a threaded port or the like.

While the present invention has been described and illustrated herein with respect to preferred embodiments, it should be apparent that various modifications, adaptations and variations may be made utilizing the teachings of the present disclosure without departing from the scope of the invention and are intended to be within the scope of the present invention. In light of the foregoing, it will now be appreciated by those skilled in art that modifications may be made to the disclosed embodiments without departing from the spirit and scope of the invention as defined by the appended claims.

What is claimed is:

1. A connector for coupling an end of a coaxial cable to a threaded port, the coaxial cable having a center conductor surrounded by a dielectric, the dielectric being surrounded by a protective outer jacket, said connector comprising:

a. a post having a first end adapted to be inserted into an end of the coaxial cable around the dielectric and under the protective outer jacket thereof, said post having an opposing second end;

b. a connector body having a first end and a second end, the first end of said connector body having an outer wall and an inner wall, the second end of said connector body operatively attached to said post, the inner wall bounding a first central bore extending about said post for receiving the coaxial cable within the first central bore, said first end of said connector body member being deformable; and c. a fastener member having a first end and a second opposing end with a central passageway defined between the fastener member first end and the fastener member second end for allowing a portion of the coaxial cable to pass there through, the fastener member secured to the connector body prior to installation over the end of the coaxial cable in a pre-installed first configuration, the central passageway being dimensioned to compress the connector body radially inwardly to decrease the volume of the first central bore when the fastener member is slidingly moved from the first preinstalled configuration toward the second end of the connector body, wherein said fastener member causes said connector body to be deformed inwardly toward said post and against the protective outer jacket of the coaxial cable as said fastener member is advanced over the connector body toward the second end of said connector body.

2. The connector of claim 1, wherein the central passageway of the fastener member includes a ramped surface.

3. The connector of claim 2, wherein the first inner bore of the fastener member is tapered.

4. The connector of claim 2, wherein the central passageway of the fastener member includes an internal groove.

5. The connector of claim 2, wherein the central passageway of the fastener member further includes a first inner bore having a first diameter at a first end and a second inner bore having a second diameter at a second end, said second diameter is less than said first diameter, and wherein the ramped surface is positioned between the first inner bore and the second inner bore.

6. The connector of claim 5, wherein the first inner bore of the fastener member is dimensioned to radially compress the first end of the connector body inwardly when the fastener member is in the first preinstalled configuration.

7. The connector of claim 5, wherein the first inner bore of the fastener member is dimensioned to provide a press-fit between the first end of the connector body and the fastener member, when the fastener member is in the first preinstalled configuration.

8. The connector of claim 5, wherein the first inner bore of the fastener member has a constant diameter.

9. The connector of claim 5, wherein the first inner bore of the fastener member is non-tapered.

10. The connector of claim 5, wherein the first inner bore of the fastener member is tapered.

11. The connector of claim 1, wherein the fastener member is slidingly moved from the first preinstalled configuration toward the second end of the connector body without rotation.

12. The connector of claim 1, wherein the first end of said connector body is secured to said fastener member by a detent.

13. The connector of claim 12, wherein the fastener member includes an internal groove for cooperating with said detent.

14. The connector of claim 1, wherein the inner wall of the first end of the connector body includes annular serrations which cooperate with the post to provide a generally continuous, 360° seal and grip on the coaxial cable.

15. The connector of claim 1, wherein the first end of the connector body includes a tapered portion.

16. The connector of claim 1, wherein the post member is metallic.

17. The connector of claim 1, wherein the post member is of a plastic composition.

18. The connector of claim 1, wherein the connector body is metallic.

19. The connector of claim 1, wherein the connector body is of a plastic composition.

20. The connector of claim 1, wherein the fastener member is metallic.

21. The connector of claim 1, wherein the fastener member is of plastic composition.

22. A connector for coupling an end of a coaxial cable to a threaded port, the coaxial cable having a center conductor surrounded by a dielectric, the dielectric being surrounded by a protective outer jacket, said connector comprising:

a. a post having a first end adapted to be inserted into an end of the coaxial cable around the dielectric and under the protective outer jacket thereof, said post having an opposing second end;

b. a connector body having a first end and a second end, the first end of said connector body having an outer wall and an inner wall, the second end of said connector body operatively attached to said post, the inner wall bounding a first central bore extending about said post for receiving the coaxial cable within the first central bore, said first end of said connector body member being deformable; and c. a fastener member having a first end and a second opposing end with a central passageway defined between the fastener member first end and the fastener member second end for allowing a portion of the coaxial cable to pass there through, the fastener member secured to the connector body prior to installation over the end of the coaxial cable in a pre-installed first configuration, the central passageway being dimensioned to compress the connector body radially inwardly to decrease the volume of the first central bore when the fastener member is slidingly moved from the first preinstalled configuration toward the second end of the connector body, wherein said fastener member causes said connector body to be deformed inwardly toward said post and against the protective outer jacket of the coaxial cable as said fastener member is advanced over the connector body toward the second end of said connector body wherein a corrugated surface portion is formed in the outer wall of the first end of the connector body to reduce driving force as the fastener member is slidingly advanced along said connector body.

23. A connector for coupling an end of a coaxial cable to a threaded port, the coaxial cable having a center conductor surrounded by a dielectric, the dielectric being surrounded by a protective outer jacket, said connector comprising:

a. a cost having a first end adapted to be inserted into an end of the coaxial cable around the dielectric and under the protective outer jacket thereof, said post having an opposing second end;

b. a connector body having a first end and a second end, the first end of said connector body having an outer wall and an inner wall, the second end of said connector body operatively attached to said post, the inner wall bounding a first central bore extending about said post for receiving the coaxial cable within the first central bore, said first end of said connector body member being deformable; and c. a fastener member having a first end and a second opposing end with a central passageway defined between the fastener member first end and the fastener member second end for allowing a portion of the coaxial cable to pass there through, the fastener member secured to the connector body prior to installation over the end of the coaxial cable in a pre-installed first configuration, the central passageway being dimensioned to compress the connector body radially inwardly to decrease the volume of the first central bore when the fastener member is slidingly moved from the first preinstalled configuration toward the second end of the connector body, wherein said fastener member causes said connector body to be deformed inwardly toward said post and against the protective outer jacket of the coaxial cable as said fastener member is advanced over the connector body toward the second end of said connector body, wherein a series of grooves are formed in the outer wall of the first end of said connector body to reduce drag as the fastener member is slidingly advanced over said connector body.

* * * * *

US006848940C1

(12) EX PARTE REEXAMINATION CERTIFICATE (10459th)

United States Patent
Montena

(10) Number: US 6,848,940 C1
(45) Certificate Issued: Jan. 5, 2015

(54) CONNECTOR AND METHOD OF OPERATION

(75) Inventor: Noah P Montena, Syracuse, NY (US)

(73) Assignee: Wells Fargo Bank, National Association, Charlotte, NC (US)

Reexamination Request:
No. 90/013,069, Nov. 27, 2013

Reexamination Certificate for:

| | |
|---|---|
| Patent No.: | **6,848,940** |
| Issued: | **Feb. 1, 2005** |
| Appl. No.: | **10/348,652** |
| Filed: | **Jan. 21, 2003** |

Related U.S. Application Data

(63) Continuation of application No. 09/621,975, filed on Jul. 21, 2000, now Pat. No. 6,558,194, which is a continuation of application No. 08/910,509, filed on Aug. 2, 1997, now Pat. No. 6,153,830.

(51) Int. Cl.
*H01R 9/05* (2006.01)

(52) U.S. Cl.
USPC ..... 439/584; 439/583; 439/578; D13/133

(58) Field of Classification Search
None
See application file for complete search history.

(56) References Cited

To view the complete listing of prior art documents cited during the proceeding for Reexamination Control Number 90/013,069, please refer to the USPTO's public Patent Application Information Retrieval (PAIR) system under the Display References tab.

*Primary Examiner* — Leonardo Andujar

(57) ABSTRACT

A connector includes a connector body, a post member, and a fastener member. In one embodiment, the connector provides for coupling a coaxial cable having a center conductor, an insulator core, an outer conductor, and a sheath to a terminal device. A nut coupled to either the connector body or post member can be used on the connector to make the connection to the device. The post member has a cavity that accepts the center conductor and insulator core of a coaxial cable. An outer cavity is formed by the connector body and the post member such that the outer conductor and the sheath of a coaxial cable are positioned therebetween. The fastener member, in a pre-installed first configuration is movably fastened onto the connector body. The fastener member can be moved toward the nut into a second configuration in which the fastener member coacts with the connector body so that the connector sealingly grips the coaxial cable.

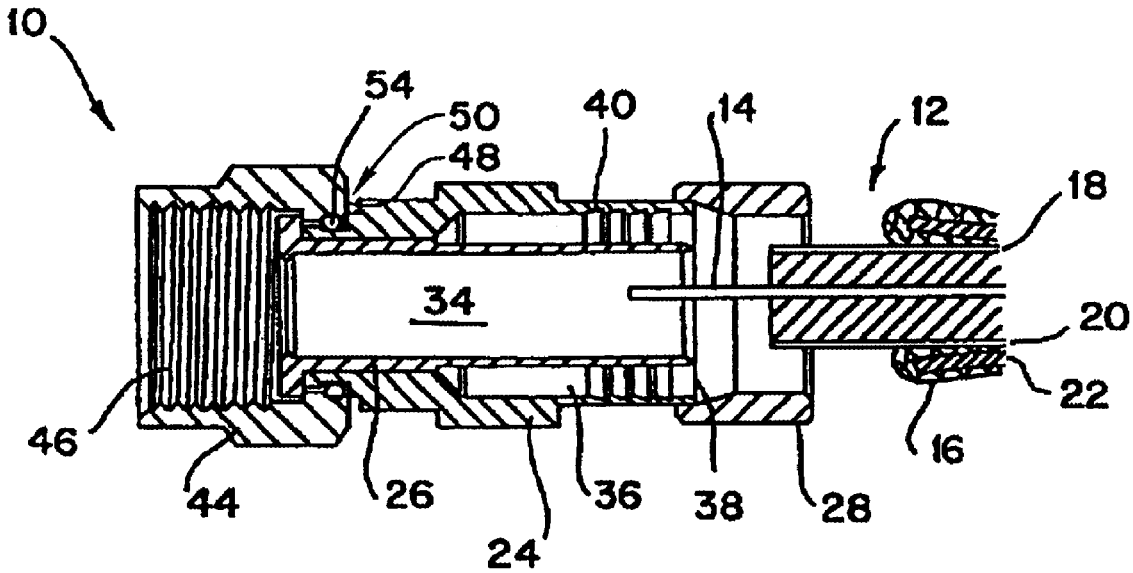

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-23 is confirmed.

* * * * *